US009908687B2

(12) United States Patent
Chiou et al.

(10) Patent No.: US 9,908,687 B2
(45) Date of Patent: Mar. 6, 2018

(54) TRAVEL BEVERAGE CONTAINER

(71) Applicant: IGNITE USA, LLC, Chicago, IL (US)

(72) Inventors: Joe Chiou, Wilmette, IL (US); Marjavis J. Matthis, Chicago, IL (US); Blair Miller, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 126 days.

(21) Appl. No.: 14/802,097

(22) Filed: Jul. 17, 2015

(65) Prior Publication Data

US 2015/0344199 A1 Dec. 3, 2015

Related U.S. Application Data

(60) Continuation-in-part of application No. 14/499,982, filed on Sep. 29, 2014, which is a division of
(Continued)

(51) Int. Cl.
*B65D 83/22* (2006.01)
*B65D 43/26* (2006.01)
(Continued)

(52) U.S. Cl.
CPC ..... *B65D 83/22* (2013.01); *A45F 3/16* (2013.01); *A47G 19/2272* (2013.01);
(Continued)

(58) Field of Classification Search
CPC ..... B65D 83/22; B65D 43/02; B65D 43/265; B65D 43/267; B65D 43/26; B65D 47/20;
(Continued)

(56) References Cited

U.S. PATENT DOCUMENTS 830,142 A 9/1906 Ebbing
1,072,588 A 9/1913 Duncan
(Continued)

FOREIGN PATENT DOCUMENTS

CN 2198839 Y 5/1995
CN 1345682 A 4/2002
(Continued)

OTHER PUBLICATIONS

International Preliminary Report on Patentability, International Application No. PCT/US2012/064801, dated May 20, 2014.
(Continued)

*Primary Examiner* — Jeffrey Allen
*Assistant Examiner* — Jennifer Castriotta
(74) *Attorney, Agent, or Firm* — Marshall, Gerstein & Borun LLP

(57) ABSTRACT

A lid assembly for a beverage container having a lid housing, a seal assembly and a trigger member. The seal assembly has a drink seal to close the drink aperture. The seal assembly is rotatedly connected to the lid housing and movable between a use position and a cleaning position to allow the drink aperture to be open for cleaning. The trigger member is connected to the lid housing and is capable of engaging the seal assembly in the use position, but it cannot engage the seal assembly in the cleaning position. Additionally, a trigger lock is connected to the lid housing to prevent engagement of the seal assembly by the trigger member when the trigger lock is locked. The trigger lock may also contain a visual indicator to indicate that the lock is in the locked position.

18 Claims, 15 Drawing Sheets

Related U.S. Application Data application No. 13/674,705, filed on Nov. 12, 2012, now Pat. No. 8,844,762.

(60) Provisional application No. 61/560,080, filed on Nov. 15, 2011.

(51) Int. Cl.

| | |
|---|---|
| ***B65D 47/24*** | (2006.01) |
| ***B65D 47/20*** | (2006.01) |
| ***A45F 3/16*** | (2006.01) |
| ***A47G 19/22*** | (2006.01) |
| ***B65D 43/02*** | (2006.01) |
| *B05B 11/00* | (2006.01) |

(52) U.S. Cl.

CPC ..... *B65D 43/02* (2013.01); *B65D 43/265* (2013.01); *B65D 43/267* (2013.01); *B65D 47/20* (2013.01); *B65D 47/248* (2013.01); *B05B 11/0027* (2013.01); *B05B 11/3059* (2013.01)

(58) Field of Classification Search

CPC .... B65D 47/248; B65D 47/249; B65D 43/22; B05B 11/3059; B05B 11/0027; A47G 19/2272

USPC ..... 222/153.13, 153.14; 220/715, 402.11

See application file for complete search history.

(56) References Cited

U.S. PATENT DOCUMENTS 2,193,232 A 3/1940 Hacmac
2,447,870 A 8/1948 Polcyn
2,622,420 A 12/1952 Rice
2,799,437 A 7/1957 Jepson
3,059,816 A 10/1962 Goldstein
D209,483 S 12/1967 Frank
3,635,380 A 1/1972 Fitzgerald
3,739,938 A 6/1973 Paz
3,828,982 A * 8/1974 Steigerwald ..... B65D 50/045 222/153.11
3,964,631 A 6/1976 Albert
3,967,748 A 7/1976 Albert
3,972,443 A 8/1976 Albert
4,094,433 A 6/1978 Numbers
4,099,642 A 7/1978 Nergard
4,136,799 A 1/1979 Albert
4,171,060 A 10/1979 Howard et al.
4,212,408 A 7/1980 Valenzona
4,276,992 A 7/1981 Susich
4,303,173 A 12/1981 Nergard
4,582,228 A * 4/1986 Diamond ..... B65D 83/205 222/153.11
D288,667 S 3/1987 Miner
D291,537 S 8/1987 Crawford et al.
4,706,313 A 11/1987 Murphy
4,711,372 A 12/1987 Gach
4,712,704 A 12/1987 Ramsey et al.
4,779,766 A 10/1988 Kinsley
4,801,053 A 1/1989 Kaster
4,881,668 A 11/1989 Kitterman et al.
D315,872 S 4/1991 Bixler
5,039,158 A 8/1991 Maier
5,082,134 A 1/1992 Ramsey
5,118,014 A 6/1992 Hestehave et al.
5,153,977 A 10/1992 Toida et al.
5,169,016 A 12/1992 Hinz, Jr.
5,186,353 A 2/1993 Ramsey
5,199,597 A 4/1993 Gladish
5,222,623 A 6/1993 Eger et al.
5,244,113 A 9/1993 Stymiest
5,249,703 A 10/1993 Karp
5,252,278 A 10/1993 Spann et al.
5,282,551 A * 2/1994 Pierson ..... B65D 83/205 222/153.11
5,307,950 A 5/1994 Li
5,412,821 A 5/1995 Wilkinson
5,427,271 A 6/1995 Wang
5,462,185 A 10/1995 Walker, III
5,465,866 A 11/1995 Belcastro
5,477,980 A 12/1995 Chaffin
5,485,938 A 1/1996 Boersma
D367,611 S 3/1996 Wagner, III et al.
D373,927 S 9/1996 Kramer et al.
5,570,797 A 11/1996 Yeh
5,573,139 A 11/1996 Yeh
5,580,504 A 12/1996 Spann et al.
5,630,238 A 5/1997 Weismiller et al.
5,652,985 A 8/1997 Wilkinson et al.
5,680,951 A 10/1997 Feltman, III et al.
D386,948 S 12/1997 Wissinger
5,753,289 A 5/1998 Ness
D394,778 S 6/1998 Arns et al.
D397,905 S 9/1998 Hsu
D404,613 S 1/1999 Hatsumoto et al.
D405,011 S 2/1999 DeCoster et al.
D406,006 S 2/1999 Hatsumoto et al.
D408,221 S 4/1999 Asberg
D416,755 S 11/1999 Trombly
5,987,668 A 11/1999 Ackley
D417,360 S 12/1999 Bickert et al.
6,010,029 A 1/2000 Wang
6,036,271 A 3/2000 Wilkinson et al.
6,053,474 A 4/2000 Stucke, Jr. et al.
6,098,834 A 8/2000 Hatsumoto et al.
6,102,244 A 8/2000 Kuwano et al.
6,126,035 A 10/2000 Schaper et al.
6,158,608 A 12/2000 Schlattl
RE37,016 E 1/2001 Morano
D437,229 S 2/2001 Andrew
6,276,560 B1 8/2001 Belcastro
D447,693 S 9/2001 Warner et al.
6,351,863 B1 3/2002 Meyer et al.
6,352,166 B1 3/2002 Copeland
6,401,990 B1 6/2002 Walters et al.
D460,894 S 7/2002 Ziegenfus et al.
6,443,325 B1 9/2002 Schaper et al.
6,471,085 B1 10/2002 Gallo
D470,009 S 2/2003 Turchi et al.
D471,808 S 3/2003 de Castro Couto
6,557,717 B1 5/2003 Keck
6,644,490 B2 11/2003 Clarke
6,679,397 B2 1/2004 Smith et al.
6,702,137 B1 3/2004 Kowa et al.
6,732,875 B2 5/2004 Smith et al.
6,732,876 B2 5/2004 Belcastro
6,732,964 B2 5/2004 Couchey
6,763,964 B1 7/2004 Hurlbut et al.
D500,428 S 1/2005 Ward et al.
6,854,615 B2 2/2005 von Ronn et al.
D502,844 S 3/2005 Rohe
6,901,617 B2 6/2005 Sprouse, II et al.
D508,185 S 8/2005 Gauss
6,935,536 B2 * 8/2005 Tardif ..... A47J 41/0027 222/153.14
6,952,852 B2 10/2005 Reeder et al.
6,978,910 B2 12/2005 Sanders et al.
D513,452 S 1/2006 Parve
7,011,227 B2 3/2006 Ward et al.
D522,794 S 6/2006 Imai
D523,340 S 6/2006 Westphal
7,073,678 B1 7/2006 Dibdin et al.
D526,898 S 8/2006 Isono et al.
D526,899 S 8/2006 Mangin et al.
D529,379 S 10/2006 Mengeu et al.
D529,761 S 10/2006 Trombly
D533,064 S 12/2006 Glynn et al.
7,195,137 B2 3/2007 Belcastro
D540,625 S 4/2007 Sandberg
7,201,288 B2 4/2007 von Ronn et al.
D541,572 S 5/2007 Watanabe
D544,300 S 6/2007 Tien

(56) References Cited

U.S. PATENT DOCUMENTS

| | | | |
|---|---|---|---|
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan |
| D564,840 | S | 3/2008 | Williams |
| D564,841 | S | 3/2008 | Clemens et al. |
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |
| 7,413,096 | B2 | 8/2008 | Morgan et al. |
| D577,582 | S | 9/2008 | Walsh et al. |
| D577,958 | S | 10/2008 | Homma |
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| D592,012 | S | 5/2009 | Carreno |
| D592,456 | S | 5/2009 | Pinelli et al. |
| D592,905 | S | 5/2009 | Pinelli et al. |
| D592,913 | S | 5/2009 | Pinelli et al. |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| 7,922,041 | B2 * | 4/2011 | Gurrisi ..... B65D 83/384 222/153.11 |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| 8,360,258 | B2 | 1/2013 | Gilbert et al. |
| D675,873 | S | 2/2013 | Miller et al. |
| D676,278 | S | 2/2013 | Wong |
| 8,464,895 | B2 | 6/2013 | Gilbert et al. |
| D686,074 | S | 7/2013 | Brinckerhoff et al. |
| 8,622,229 | B2 | 1/2014 | Lane |
| 8,844,762 | B2 | 9/2014 | Chiou et al. |
| 8,863,979 | B2 | 10/2014 | El-Saden et al. |
| 9,113,698 | B2 | 8/2015 | Blain et al. |
| 2003/0071041 | A1 | 4/2003 | Vogel |
| 2005/0029265 | A1 | 2/2005 | Morgan et al. |
| 2006/0043091 | A1 | 3/2006 | Pinelli et al. |
| 2006/0226160 | A1 | 10/2006 | Elsaden et al. |
| 2007/0170184 | A1 | 7/2007 | Canedo |
| 2007/0210093 | A1 | 9/2007 | Pinelli |
| 2010/0276454 | A1 * | 11/2010 | Espinoza ..... B05B 11/3059 222/153.13 |
| 2012/0285961 | A1 | 11/2012 | Roth et al. |
| 2013/0119060 | A1 | 5/2013 | Chiou et al. |
| 2014/0197170 | A1 | 7/2014 | Carlile et al. |
| 2015/0014339 | A1 | 1/2015 | Chiou et al. |

FOREIGN PATENT DOCUMENTS

| | | | |
|---|---|---|---|
| CN | 1432512 | A | 7/2003 |
| CN | 1636835 | A | 7/2005 |
| JP | 2005193944 | A | 7/2005 |
| WO | WO-2005/115204 | A1 | 12/2005 |

OTHER PUBLICATIONS

Office Action, Canadian Patent Application No. 2,935,655, dated Aug. 31, 2017.

* cited by examiner

TRAVEL BEVERAGE CONTAINER

CROSS-REFERENCE TO RELATED APPLICATIONS

This application is a continuation-in-part of U.S. patent application Ser. No. 14/499,982, filed Sep. 29, 2014, which is a divisional of U.S. Pat. No. 8,844,762, issued on Sep. 30, 2014, which claims the benefit of U.S. Provisional Patent Application No. 61/560,080, filed Nov. 15, 2011, all of which are incorporated herein by reference in their entirety and made a part hereof.

FEDERALLY SPONSORED RESEARCH OR DEVELOPMENT

Not Applicable.

TECHNICAL FIELD

The present invention relates generally to a beverage container, and more specifically to a travel beverage container with a cleanable and lockable trigger mechanism.

BACKGROUND OF THE INVENTION

Beverage containers and trigger mechanisms for beverage containers are well known in the art. Traditionally, trigger mechanisms are located in the lid of the beverage container and are secured in a fixed location in the lid. While such beverage containers and trigger mechanisms according to the prior art provide a number of advantages, they nevertheless have certain limitations. For example, debris may be retained between certain components that are secured together. Further, the area between the seals associated with the trigger mechanism and the lid, and other components of the trigger mechanism are difficult to properly clean, especially in a dishwasher environment. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink apertures, but where the seal assembly is not disassembled or removed from the lid during conversion from the use position to the cleaning position, and wherein the seal assembly is operated by a trigger assembly that is pushed radially inwardly in a direction transverse to a longitudinal axis of the beverage container.

The disclosed subject technology further relates to a lid having a lock connected to the lid housing. The lock prevents engagement of the seal assembly by the trigger assembly even when the seal assembly is in the operable position.

The disclosed subject technology further relates to a lid having a seal assembly and a trigger member. The seal assembly has a drink seal that engages a first drink aperture to close the drink aperture. The seal assembly is rotatedly connected to the lid housing and movable between a first or operable position, and a second or cleaning position. The seal assembly can be rotated away from a drink surface of the lid housing so that the drink aperture is open for cleaning the lid assembly in the cleaning position. The trigger member is connected to the lid housing and is capable of engaging the seal assembly in the operable position, but the trigger assembly cannot engage the seal assembly in the cleaning position.

The disclosed subject technology further relates to a lid assembly for a beverage container comprising a lid housing, a seal assembly connected to the lid housing and having a seal arm and a drink seal to close a drink opening in the lid housing, a trigger assembly connected to the lid housing to operate the seal assembly, the trigger assembly having a trigger member that engages the seal arm, and a trigger lock adjacent a side of the lid housing. The trigger lock is moveable from a first position to a second position. The trigger lock engages the trigger member in a first position to prevent the trigger member from moving the seal arm, and the trigger lock does not prevent the trigger member from moving the seal arm in the second position.

The disclosed subject technology further relates to a lid assembly for a beverage container comprising a lid housing having a first aperture at one side of the housing and a second aperture at an opposing side of the housing, a trigger member connected to the lid housing to operate a drink seal to close a drink opening in the lid housing, and a trigger lock moveable from a first locked position to a second unlocked position. The trigger lock engages the trigger member in the first locked position to prevent the trigger member from operating the drink seal to open the drink opening. The trigger lock does not prevent the trigger member from moving the seal arm in the second unlocked position. A portion of the trigger lock partially extends out of the second aperture when the trigger lock is in the first locked position, and a portion of the trigger lock partially extends out of the first aperture when the trigger lock is in the second unlocked position.

The disclosed subject technology further relates to a lid assembly for a drinking container comprising a lid housing having a drink opening, a seal assembly pivotally connected to the lid housing and movable between a first or operable position, wherein a drink seal of the seal assembly engages a drink opening to close the drink opening, and a second or cleaning position, wherein the seal assembly is rotated away from a drink surface of the lid housing and wherein the drink opening is open for cleaning the lid assembly, a trigger assembly connected to the lid housing to operate the seal assembly, the trigger assembly having a trigger member that engages the seal assembly, and, a trigger lock adjacent a side of the lid housing, the trigger lock moveable from a first locked position to a second unlocked position, wherein the trigger lock engages the trigger member in a first locked position to prevent the trigger member from moving the seal arm, and wherein the trigger lock does not prevent the trigger member from moving the seal arm in the second unlocked position.

The disclosed subject technology further relates to a lid housing having a first aperture at one side of the housing and a second aperture at an opposing side of the housing, and wherein the trigger lock comprises a locking shaft that partially extends out of the second aperture when the trigger lock is in the first position, and partially extends out of the first aperture when the trigger lock is in the second position.

The disclosed subject technology further relates to a stopper connected to the locking shaft, the stopper engaging the trigger member when the trigger lock is in the first position.

The disclosed subject technology further relates to a cutout in the trigger member for receiving the trigger lock.

The disclosed subject technology further relates to a trigger lock that comprises a locking shaft and a stopper connected to the locking shaft, the stopper being received in the cutout when the trigger lock is in the first position.

The disclosed subject technology further relates to a leaf spring to alternately maintain the trigger lock in the first position and in the second position until a sufficient force is applied to the trigger lock to overcome a resistance of the leaf spring.

The disclosed subject technology further relates to a trigger lock that contains a visual indicator to indicate that the trigger lock is in the first position.

The disclosed subject technology further relates to a trigger lock that slides about an arcuate track to move from the first position to the second position. A stopper portion of the trigger lock engages a protrusion of the trigger member to prevent the trigger member from being actuated in the first position, and wherein the stopper portion of the trigger lock is positioned a distance from the protrusion of the trigger member to allow the trigger member to be actuated in the second position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
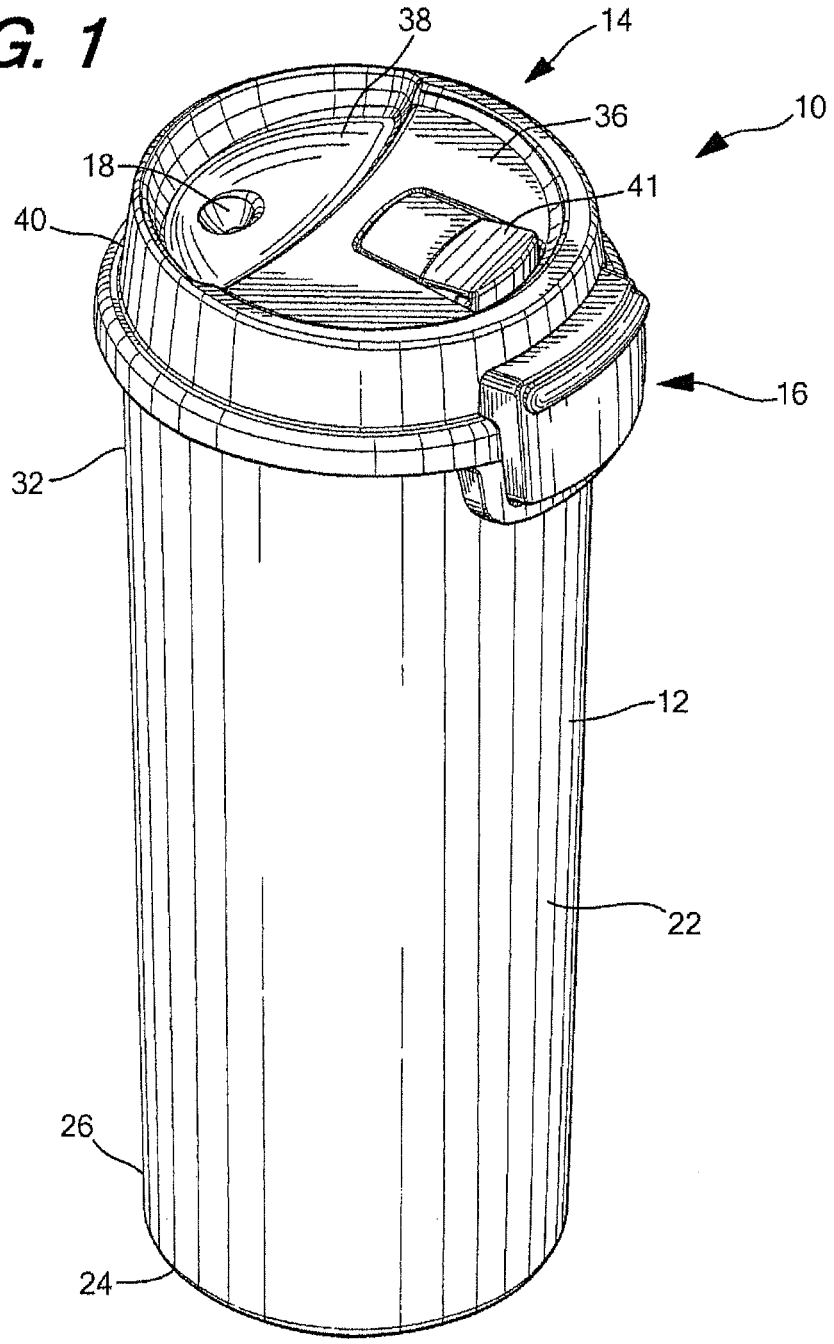
FIG. 1 is a perspective view of one example of a beverage container with a moveable and lockable trigger mechanism.
Figure 2:
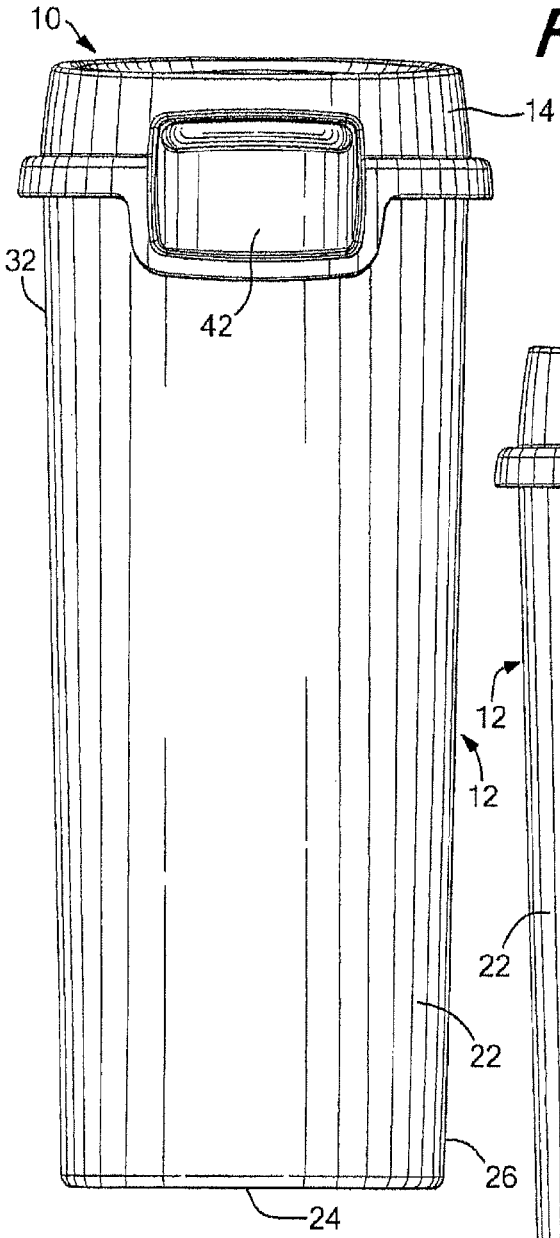
FIG. 2 is a front elevation view of the beverage container of FIG. 1.
Figure 3:
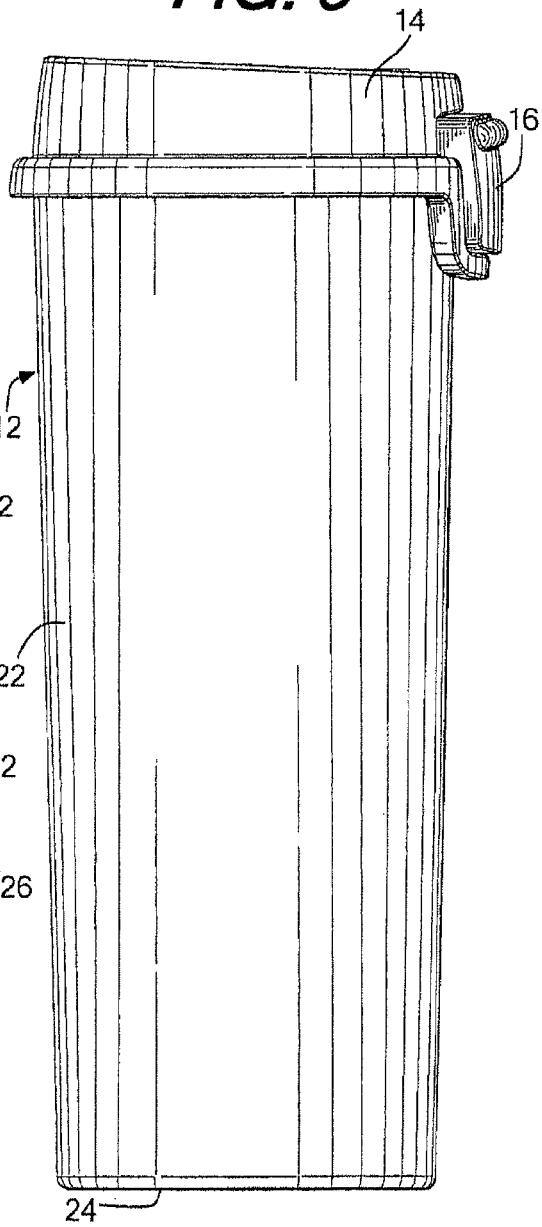
FIG. 3 is a side elevation view of the beverage container of FIG. 1.
Figure 4:
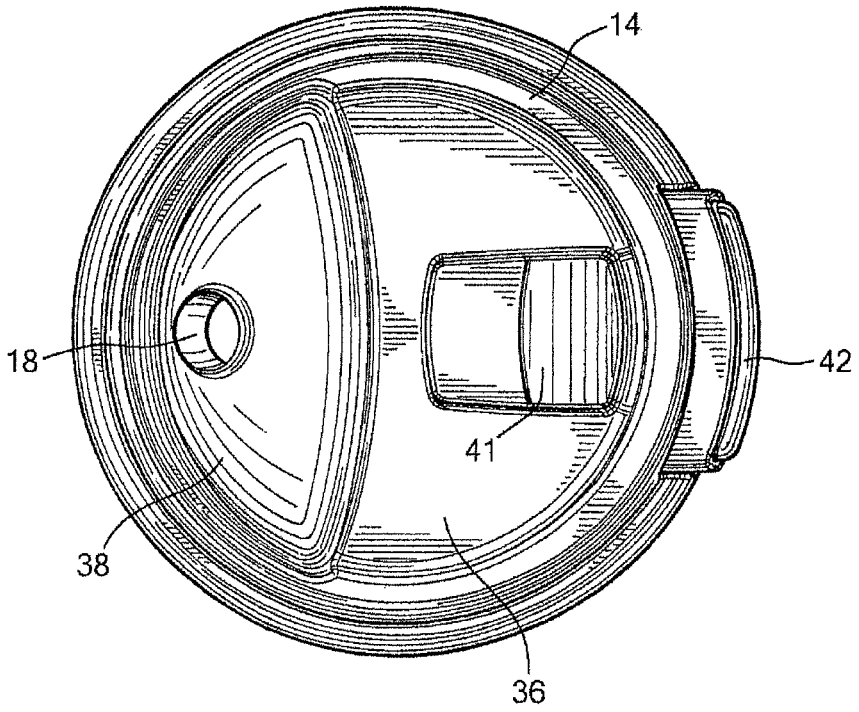
FIG. 4 is a top plan view of the beverage container of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 5:
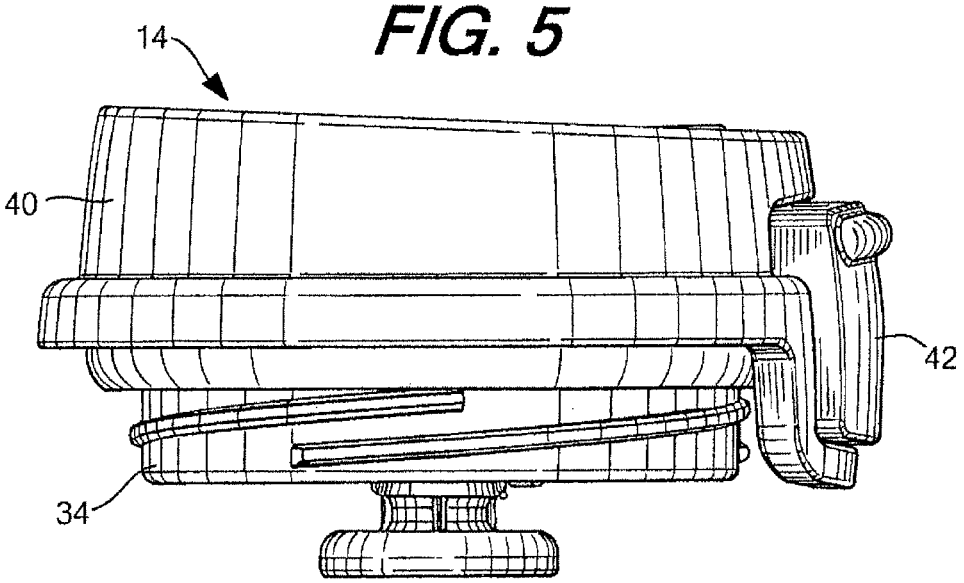
FIG. 5 is a side elevation view of one embodiment of a lid for a beverage container, including a thread ring for the lid.
Figure 6:
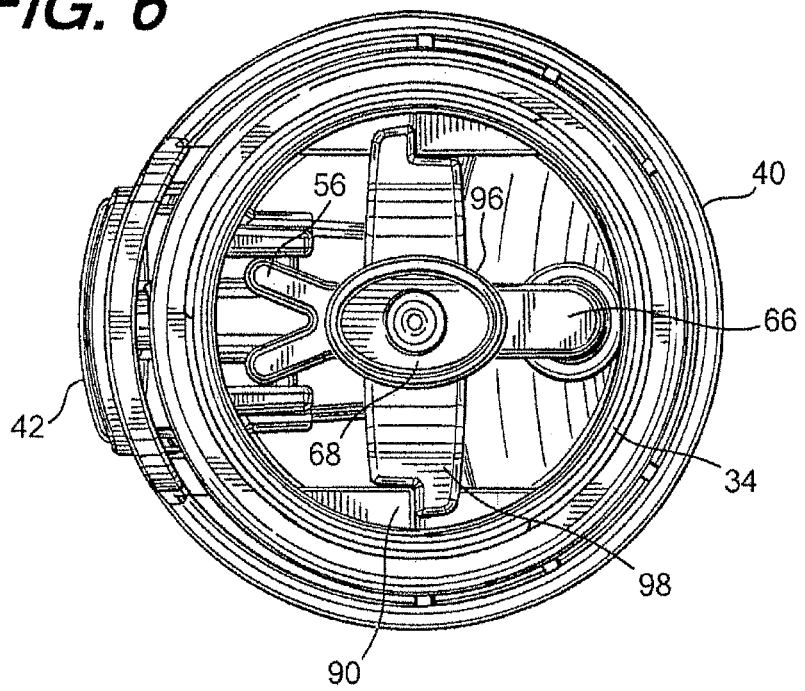
FIG. 6 is a bottom plan view of one embodiment of a trigger mechanism for a beverage container, with the seal assembly in the engaged position.
Figure 7:
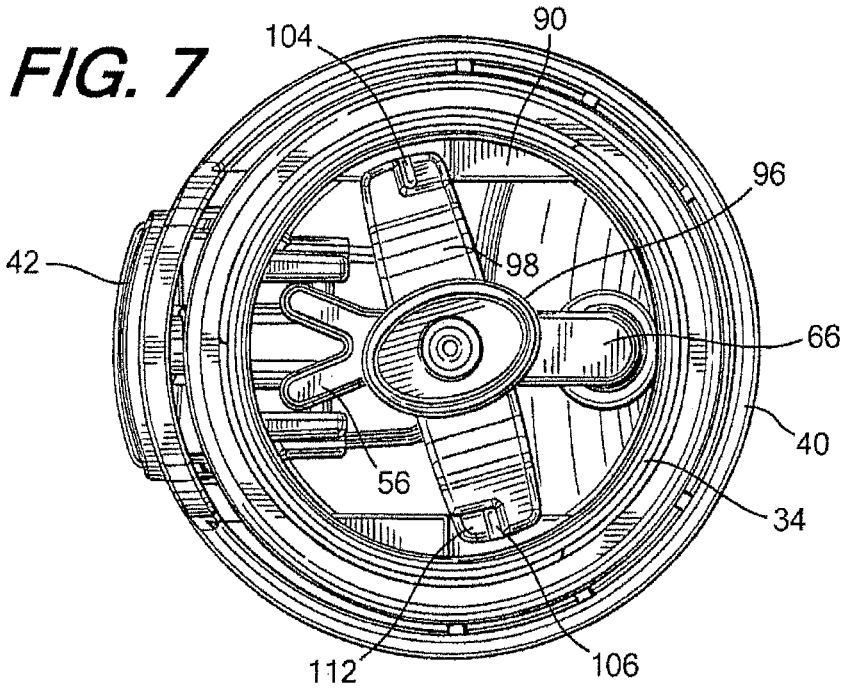
FIG. 7 is a bottom plan view of the trigger assembly of FIG. 6, with the seal assembly in the disengaged position.
Figure 10:
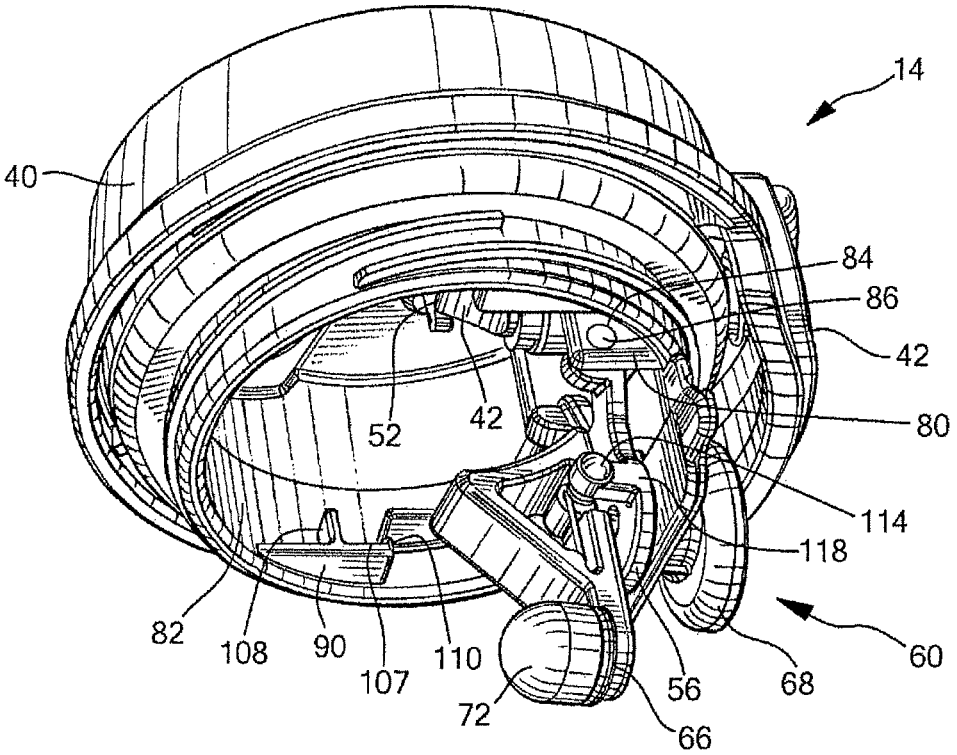
FIG. 10 is a partial bottom perspective view of one embodiment of the seal mechanism in the open position.

Referring now to the figures, and specifically to FIGS. 1-8, there is shown a beverage container 10 generally comprising a container body 12 and a lid assembly 14. The lid assembly 14 has a trigger mechanism 16 that operates to open and close a drinking aperture 18 in the lid assembly 14. Additionally, the trigger mechanism 16 also preferably operates to open and close a vent aperture 20 to allow pressure residing within the container body 12 to be released initially through the vent aperture 20 as opposed to the drink aperture 18. In a preferred embodiment, as shown in FIGS. 7 and 10, a portion of the trigger mechanism 16, referred to herein as the seal mechanism, can be released from a fixed or closed position to a released or open position to allow for cleaning of various components of the trigger mechanism 16 and for cleaning of areas between components of the trigger mechanism 16 and the lid assembly 14.

In one embodiment the container body 12 comprises a side wall member 22, a bottom member 24 toward a distal end 26 of the side wall member 22, and a liquid retaining cavity (not shown) therebetween. Further, in another embodiment the container body 12 preferably comprises a two-part construction of an inner member and an outer member to provide an insulating feature. The area between the inner member and the outer member may be filled with an insulating material or it may be under vacuum.

Figure 8:
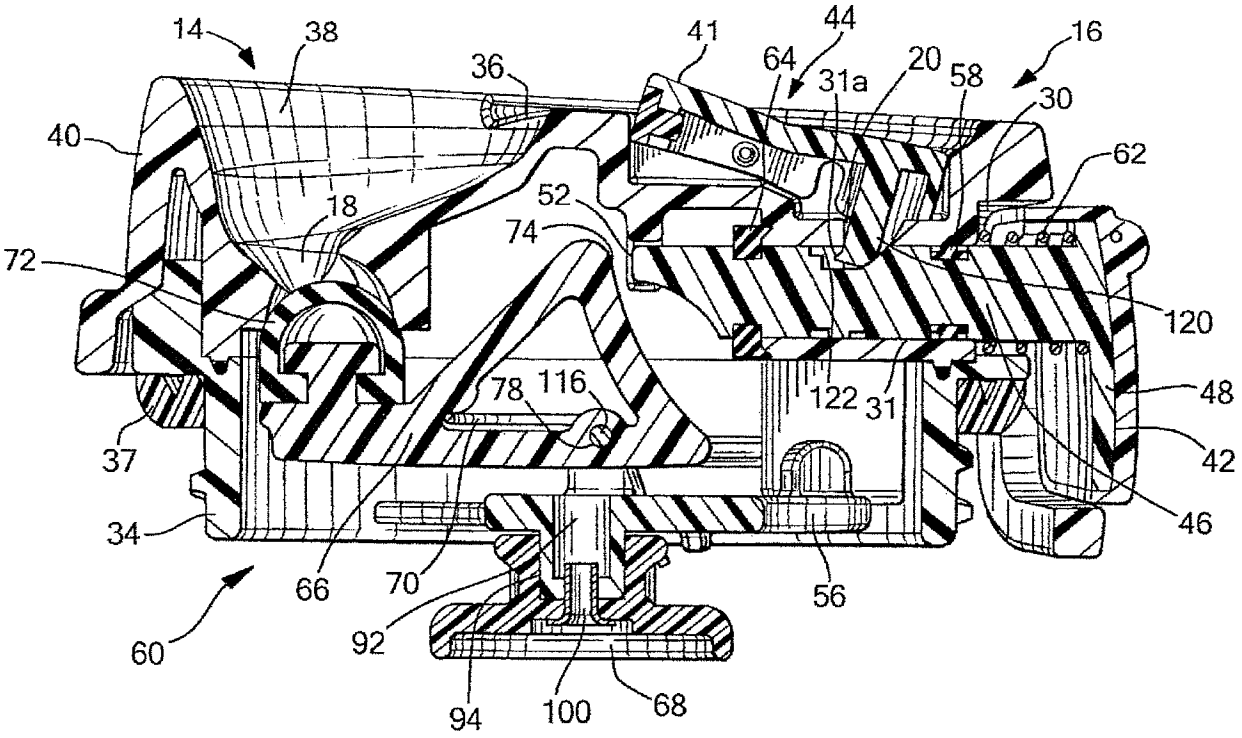
FIG. 8 is a partial cross-section side view of one embodiment of the trigger mechanism with the trigger in the normal position and the vent-trigger lock in the locked position.
Figure 9:
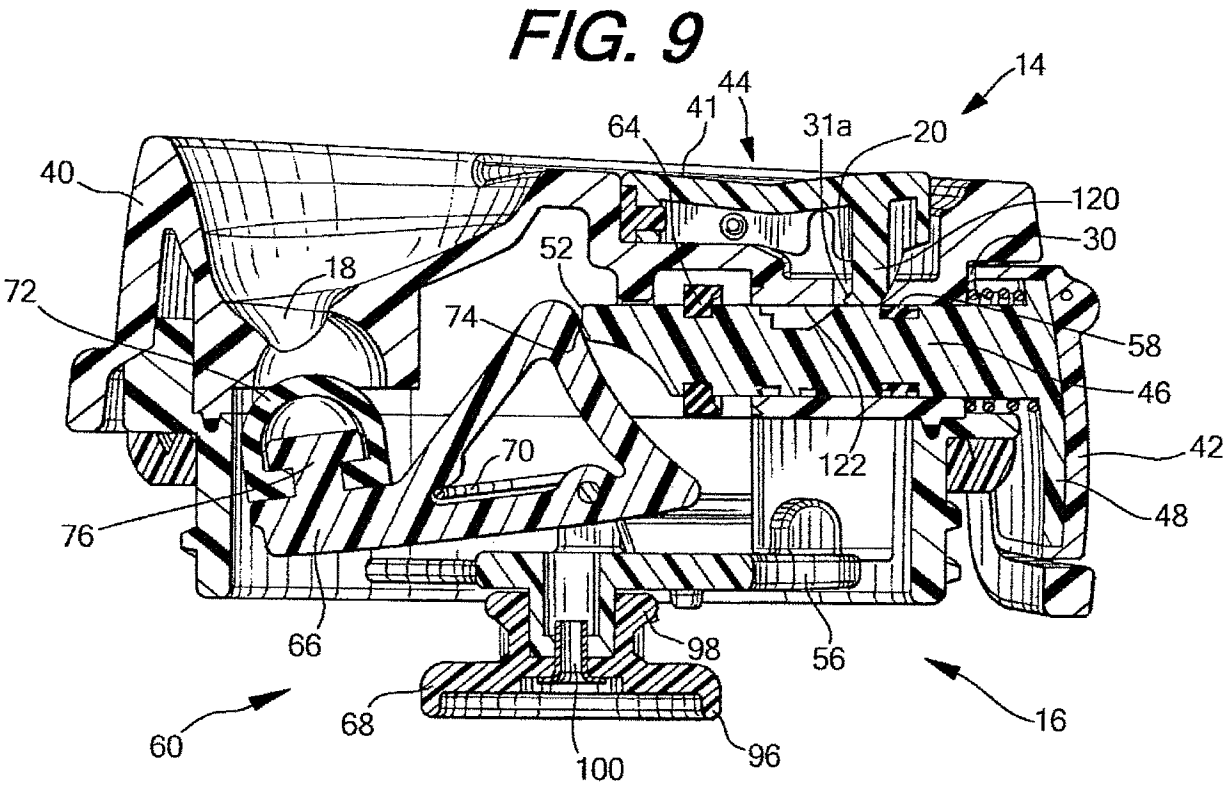
FIG. 9 is a partial cross-section side view of one embodiment of the trigger mechanism with the trigger in the actuated position and the vent-trigger lock in the open position.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating receiver on the container body 12, however, alternate connection means may be utilized. In one embodiment the thread ring 34 extends from or is fixedly connected to the lid housing 40, such as via welding of the two components, as shown in FIGS. 5, 8 and 9. As shown in FIGS. 8 and 9, the lid assembly 14 further includes a seal 37 that seals the connection between the container body 12 and the lid assembly 14 to assist in preventing liquid from escaping from the cavity of the container body 12 between the container body 12 and the lid assembly 14.

In one embodiment the lid assembly 14 comprises a lid housing 40 for retaining the trigger mechanism 16. In one embodiment the top surface 36 of the lid housing 40 has a depression 38 leading to the drink aperture 18. The depression in the top surface 36 allows fluid to be dispensed from the container through the drink aperture 18, and to be subsequently slurped by the user. Further, because the depression provides for pooling of liquid, the surface of the depression 38 may have a highly polished finish to allow any liquid that is not drunk by the user to quickly retreat back through the drink aperture 18 and into the container cavity upon tilting of the drinking container 10 toward the vertical position.

As shown in FIGS. 1-7, the lid assembly 14 also has a trigger member or trigger button 42 that operates to actuate the trigger mechanism 16, and as shown in FIGS. 8-9 and 12-15, the lid assembly 14 also has a trigger lock mechanism 44 for locking the trigger member 42 and preventing the user from actuating the trigger mechanism 16 when the trigger member 42 is locked to prevent unwanted opening of the drink aperture 18.

The lid housing 40 of the lid assembly 14 has a plurality of apertures therein. Preferably, the lid housing 40 contains the drink aperture 18 (see FIGS. 1 and 9) and the vent aperture 20 (see FIGS. 9 and 12) that provide egress for the contents in the container cavity 28 through the lid housing 40. Generally, the operation of the trigger assembly 16, and particularly the operation of the vent seal 64 of the vent aperture 20, provides to allow pressure residing within the container body 12 to preferably be initially released through the vent aperture 20 as opposed to the drink aperture 18. In one embodiment, the vent aperture 20 is provided in a position in the lid housing 40 that is underneath the vent deflector 41 that is a part of the trigger lock mechanism 44.

As best shown in FIGS. 6-11, in various embodiments the trigger assembly 16 generally comprises a trigger member 42, a hinge member 56, a trigger seal 58, a trigger spring 62, a vent seal 64, a seal arm 66, a seal arm locking member 68, a drink spring 70 and a drink seal 72. Further, a portion of the overall trigger assembly 16 may be referred to as the seal assembly 60. In one embodiment the components of the seal assembly 60 generally comprise the hinge member 56, the seal arm 66, the seal arm locking member 68, the drink spring 70 and the drink seal 72.

Referring to FIGS. 8-10, in one embodiment the trigger member 42 of the trigger assembly 16 is generally L-shaped, with a main body portion 46 and a transverse portion 48 extending downwardly therefrom. Moreover, in a preferred embodiment the main body portion 46 has a shaft-like shape. The main body portion 46, however, has various cutouts about an exterior of its body to allow gaseous fluid to pass by the exterior of the trigger member and out the vent aperture 20. The trigger member 42 has a distal end 52 that engages the seal arm 66 to rotate the seal arm 66 about its pivot point, as discussed more fully herein, thereby disengaging the drink seal 72 from the drink aperture 18 in the lid assembly 14 to operably open and close the drink aperture 18.

The main body portion 46 of the trigger 42 extends through an access aperture 30 in the lid housing 40, and into a trigger chamber 31 in the lid assembly 14. A portion of the main body portion 46 of the trigger 42 is generally housed within the trigger chamber 31, and a portion of the main body portion 46 of the trigger 42, including the distal end of the trigger 52, extends out of the trigger chamber 31, which can also be referred to as the vent chamber, and into the cavity of the lid assembly 14 to contact the seal arm 66.

In a preferred embodiment the trigger 42 also seats several seals, including the trigger seal 58 and the vent seal 64. As shown in FIGS. 8 and 9, the trigger seal 58 and the vent seal 64 are both seated on the main body portion 46 of the trigger 42. Since the trigger 42 extends through the access aperture 30 and through the vent chamber, the trigger seal 58 is required to seal the access aperture opening 30 once the trigger 42 is inserted into the lid assembly 14. In a preferred embodiment the interior of the trigger chamber 31, a portion of which comprises the vent chamber, has a cylindrical shape and thus in this embodiment the trigger seal 58 is a wiper O-ring that is seated in an arcuate recess on the main body portion 46 of the trigger 42. The trigger seal 58 thus operates as a wiper seal contacting the interior surface of the trigger chamber 31 to seal the area between the interior surface of the trigger chamber 31 and the trigger 42 to prevent any liquid or vapor from escaping out of the trigger chamber 31 through the access aperture 30. The trigger seal 58 is positioned on the trigger 42 between the vent aperture 20 and the access aperture 30. In this manner the trigger seal 58 also operates as an end wall for the vent chamber portion 31*a* of the trigger chamber 31.

The vent seal 64 is also seated on the main body portion 46 of the trigger 42, however, the vent seal 64 is seated more toward the distal end 52 of the trigger 42 than the trigger seal 58. Like the trigger seal 58 the vent seal 64 is seated in an arcuate recess on the main body portion 46 of the trigger 42. This recess, however, is positioned outside of the trigger chamber 31 and adjacent the entrance aperture to the trigger chamber 31 and vent chamber 31*a*. Accordingly, in this manner the vent seal 64 operates to seal the entrance to the vent chamber 31*a* and trigger chamber 31 in a first normal position, as shown in FIG. 8, and to open the entrance to the vent chamber 31*a* and trigger chamber 31 immediately upon actuation of the trigger mechanism 16, including in the fully actuated position of FIG. 9.

Referring to FIGS. 8 and 9, the trigger spring 62 is positioned around the main body portion 46 of the trigger 42 between an exterior wall of the lid housing 40 and the transverse portion 48 of the trigger member 42. In a preferred embodiment the trigger spring 62 is a compression spring. Since the first end of the trigger spring 62 is fixed in place against the exterior wall of the lid housing 40 that does not move, the second end of the trigger spring 62 exerts an outwardly force on the trigger 42 in an attempt to maintain the trigger 42 in the normal or unactuated position (see FIG. 8). In this position the vent seal 64 is pushed up against the outside of the trigger chamber 31 at the entrance thereto, effectively sealing the entrance to the vent chamber 31*a* and the trigger chamber 31 to preclude any liquid or vapor from being able to escape out of the container cavity 28 prior to actuation of the trigger assembly 16.

The transverse portion 48 of the trigger member 42 is fixedly connected to and preferably integral with the main body portion 46 of the trigger member 42. Thus, the transverse portion 48 operates as a push-button actuator to actuate the trigger mechanism 16 and sealing assembly 60. The trigger mechanism 16 can be actuated by exerting a generally radially inward force on the trigger member 42 to overcome the opposite force of the trigger spring 62 to push the trigger member 42 radially inward in the lid assembly 14 or toward a center of the lid assembly 14, and preferably in a direction transverse to an axis extending about a length of the beverage container 10. The trigger member 42 is thus moveable from a first normal or non-actuated position shown in FIG. 8, to a partially actuated position (not shown), and ultimately to a fully actuated position shown in FIG. 9. In the partially actuated position the vent seal 64 is in the open position allowing vapor and internal pressure to be released from the container cavity 28 through the trigger chamber 31 and vent chamber and to exit out the vent orifice 20, but the drink seal 72 is closed sealing the drinking orifice 18. The gap between the distal end 52 of the trigger member 42 and the seal arm 66, shown in FIG. 8, provides a delay whereby the vent seal 64 will be moved from the opening to the trigger chamber 31 and vent chamber 31*a* allowing vapor and internal pressure to be released out the vent opening 20, but the distal end 52 of the trigger member 42 will not have contacted or engaged the seal arm 66 so the drink seal 72 remains closed on the drink opening 18. Conversely, in the fully actuated position (FIG. 9) the distal end 52 of the trigger member 42 has engaged the seal arm 66, thereby rotating the seal arm 66 about its pivot point 78, such that both the vent seal 64 and drink seal 72 are in the open position allowing liquid to be expelled out the drinking orifice 18 and allowing vapor and pressure to continue to be released from the vent opening 20.

As explained above and shown in the Figures, the trigger 42 is mechanically connected to the drink seal 72 through the seal arm 66 when the trigger 42 is actuated a sufficient distance such that the distal end 52 of the trigger 42 contacts the seal arm 66.

Figure 11:
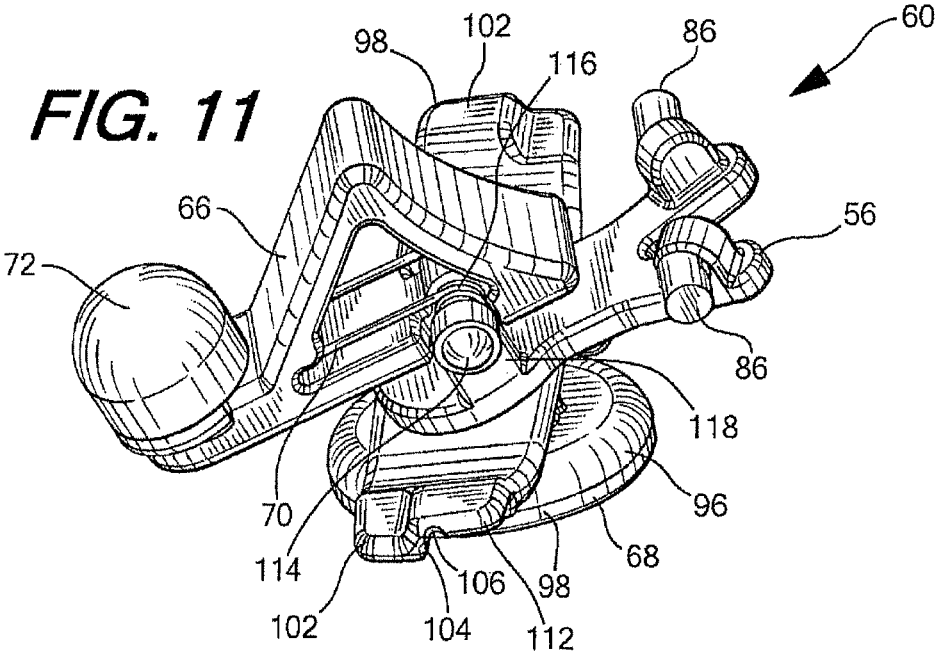
FIG. 11 is a partial top perspective view of one embodiment of the seal mechanism apart from the lid.

Referring to FIGS. 6-11, in one embodiment a portion of the trigger assembly 16, preferably the seal assembly 60, is hingedly connected to the lower or interior portion of the lid housing 40 of the lid assembly 14. In one embodiment, a pair of arms 80 extend transversely from the interior wall 82 of the lid housing 40 (see FIG. 10) to secure the seal assembly 60 to the lid housing 40. The arms 80 have a receiver 84 for rotatably securing the hinge member 56 to the lid housing 40. The receiver 84 in the arms 80 is a bore 84 that is sized to allow extensions 86 of the hinge member 56 to extend and rotate therewithin. Referring to FIGS. 10 and 11, in one embodiment the extensions 86 comprise shaft-like members that extend from the body of the hinge member 56 and into the receivers 84 in the arms 80 of the lid housing 40. As such, the hinge member 56, and the seal assembly 60 therewith, can rotate down from its engaged position in the unlocked position of the seal assembly 60 about the extensions 86 that rotate within the receivers 84 to allow access to various components of the seal assembly 60, trigger assembly 16 and lid assembly 14 for cleaning purposes.

The seal assembly 60, however, can be locked and unlocked to the lid housing 40 to either maintain the seal assembly 60 in the operable position (as shown in FIGS. 6, 8 and 9), or to allow the seal assembly 60 to be rotated downward (as shown in FIGS. 7 and 10). Referring to FIGS. 6-11, the pivotable portion of the seal assembly 60 comprises the hinge member 56, the seal arm locking member 68, the seal arm 66, the drink spring 70 and the drink seal 72. In one embodiment, the seal arm locking member 68 comprises a locking member portion or knob 96 and a pair of locking arms 98. In a preferred embodiment, the knob 96 and locking arms 98 that form the seal arm locking member 68 are a unitary component.

The seal arm locking member 68 is the component of the seal assembly 14, and thus the trigger assembly 16 as well, that is used to lock the seal assembly 14 and trigger assembly 16 in the operable position, and further unlock the seal assembly 14 and trigger assembly 16 for transitioning to the unlocked or cleaning position. In one embodiment, the seal arm locking member 68 is fixedly secured to the hinge member 56, such as with a rivet 100. In a preferred embodiment, the locking member 68 can rotate with respect to the hinge member 56 to allow the seal arm locking member 68 to transition from the locked position to the unlocked position. As shown in FIGS. 8 and 9, in one embodiment the knob 96 has a cylindrical receiver 94 and the hinge member 56 has a protruding cylindrical shoulder 92 that engages the receiver 94. In this orientation the seal arm locking member 68 can thus rotate about the protruding shoulder 92.

As best shown in FIGS. 6-7 and 10-11, the locking arms 98 of the seal arm locking member 68 extend transversely from the knob member 96. In one embodiment the seal arm locking member 68 has two locking arms 98 extending in opposite directions and spaced apart at approximately 180° to one another. In a preferred embodiment, each of the locking arms 98 have a distal end portion 102 that operates as a cam member to engage a cam surface of respective receiving members 90 on the inner wall 82 of the thread ring 34 of the lid housing 40. Referring to FIGS. 6, 7 and 11, the distal end portions 102 of the locking arms 98 have a raised portion 112, a stop 104 and a locking receiving member 106 that operate as cam followers on the cam member portions of the receiving members 90. In one embodiment the locking receiving member 106 is an indent that receives a mating protrusion in a snap-fit configuration.

In one embodiment the lid housing 40 has a pair of receiving members 90 that provides a cam receiving surface for receiving the locking arms 98 and locking the seal arm locking member 68, and thus the seal assembly 60, in the locked position. Referring to FIG. 10, in one embodiment, the receiving members 90 comprise a flat member 107 that extends transversely from the interior wall 82 of the lid housing 40. The receiving members 90 also have a stop portion 108 that extends transversely from the interior wall 82 of the lid housing 40, preferably at approximately 90° to the flat member. Finally, the receiving members 90 have a locking protrusion 110. Thus, in one embodiment the receiving members 90 are generally L-shaped and have a transverse portion (i.e., the stop 108) and horizontal portion (i.e., the flat member 107) thereto. The horizontal portions 107 of the pair of receiving members 90 extend toward one another from opposing sides of the interior wall 82 of the lid housing 40. As shown in FIGS. 6 and 7, the raised portion 112 of the locking arms 98 engage the flat member 106 of the receiving members 90 when the seal arm locking member 68 is pushed inwardly toward a top of the lid housing 40 and rotated to the closed position. The seal arm locking members 68 can be rotated from their position shown in FIG. 7, on flat member 107 (i.e., cam surface) of the receiving members 90, until the stops 104 of the locking arms 98 engage the respective stops 108 of the receiving members 90. At that point, the locking protrusions 110 of the receiving members 90 will engage the respective locking receiving members (or indents) 106 of the seal arm locking members 68 in a snap-fit orientation to lock the seal assembly 60 to the lid assembly 14 in the closed or locked position in the lid assembly 14 (see FIG. 6). Accordingly, the flats of the receivers 90 respectively operate as cam surfaces for the cam follower raised portions 112 of the locking arms 98. And, the locking receiving members 106, which in one embodiment is a depression or indent, that engage the protrusions 110 provide a tactile sensation, in a snap-fit manner, to the user that the proper rotation stroke has been reached when locking and unlocking the seal arm locking member 68. The engagement of the locking protrusions 110 in the locking receiving members 106 also operates to fix the seal assembly 60 in the locked position until the user rotates the knob 96 to unlock the seal assembly 60 for cleaning. In this manner the seal assembly 60 will not become unintentionally unlocked.

To unlock the seal arm locking member 68, and thus the seal assembly 60, the user pushes the seal assembly 60 slightly upwardly toward the lid housing 40 and performs a reverse rotation of the locking member 68. When this reverse rotation of the seal arm locking member 68 is performed, the protrusions 110 of the receiving members 90 will disengage from the indents 106 of the locking arms 98 and the locking arms can be rotated to the position shown in FIG. 7.

Referring now to FIGS. 8-11, in one embodiment the seal arm 66 of the seal assembly 60 is pivotally attached to the hinge member 56. The seal arm 66 has an engaging surface 74 that is engaged by the distal end 52 of the trigger 42 during actuation of the trigger mechanism 16. As shown in FIG. 8, the engaging surface 74 of the seal arm 66 is positioned a gap distance from the distal end 52 of the trigger member 42 in the unactuated position. The seal arm 66 also has an extension 76 to retain the drink seal 72. The extension 76 of the seal arm 66 is positioned opposite the engaging surface 74.

As shown in FIGS. 10 and 11 a pin or shaft 114 secures the seal arm 66 to the hinge member 56 is a pivoting manner. The seal arm 66 has a bore 116 through which the shaft 114 extends, and the hinge member 56 has a pair of receivers 118 that receive and secure the shaft 114 in place. Accordingly, the seal arm 66 is pivotally attached to the hinge member 56.

The drink spring 70, shown in FIGS. 10 and 11, is also provided as part of the seal assembly 60 to exert a force on the seal arm 66 to maintain the drink seal 72 in the closed position until a sufficient force is provided against the seal arm 66 through the trigger mechanism 16 to overcome the force of the drink spring 70 and thus pivot the seal arm 66 and drink seal 72 about the shaft 114 away from the drink aperture 18. During rotation of the seal arm 66 the hinge member 56 remains fixed in place and does not move. In one embodiment, the drink spring 70 is a torsion spring that is exerts a pressure on the seal arm 66 such that the seal arm 66 is forced away from the hinge member 56. Thus, when the seal assembly 60 is positioned in the locked or operational position (see FIGS. 6 and 8) the locking arms 98 of the seal arm locking member 68 are secured to the lid housing 40 through the receiving members 90. In this position, the drink seal 72 of the seal assembly 60 is forced against the drink opening 18 via the drink spring 70 to close the drink opening 18 (see FIG. 8).

When the user desires to drink from the container 10, the user depresses the trigger member 42 by pushing the trigger member 42 inward toward the container body 12 with sufficient force to overcome the resistance force of the trigger spring 62. The trigger member 42 moves inwardly and the vent seal 64 is moved from the entrance to the trigger chamber 31 and vent chamber 31*a*. During the beginning portion of the stroke of the trigger member 42 the distal end 52 of the trigger member 42 remains out of contact of the seal arm 66 because of the gap between the seal arm 66 and the trigger member 42 (see FIG. 8). When sufficient stroke of the trigger member 42 has occurred, the distal end 52 of the trigger member 42 will contact the seal arm 66. Further stroke movement of the trigger member 42 will operate to push against the seal arm 66, thereby causing the seal arm 66 to rotate about the shaft 114 at its pivot point 78 within the receivers 118 of the hinge member 56 because the hinge member 56 is fixed in the locked position. To rotate the seal arm 66 the force exerted on the trigger member 42 must not only be sufficient to overcome the continuing force of the trigger spring 62, but also be sufficient to overcome the force of the drink spring 70, thus allowing the seal arm 66 to compress the drink spring 70 and have the drink seal 72 be moved away from the drink apertures 18 to allow liquid to escape out of the drink aperture 18 for drinking.

When the user removes force from the drink trigger 42 (i.e., generally by removing their finger or thumb from the trigger 42), the force of the drink spring 70 will force the seal arm 66 to rotate toward the lid housing 40 and thereby have the drink seal 72 forced against the drink opening 18 to close the drink opening 18. Further, the trigger spring 62 will continue to force the trigger 42 outwardly to seal the vent seal 64 against the outside of the seal chamber 31*a* and trigger chamber 31, thereby closing the vent opening 20.

If the user desires to clean the lid assembly 14, the user can rotate the seal assembly 60 away from the lid housing 40 to provide access to the area between the drink opening 18 and the drink seal 72. To do such, in one embodiment the user rotates the locking member 96 of the seal arm locking member 68 approximately 50°. By rotating the knob 96 of the seal arm locking member 68 the locking arms 98 will simultaneous rotate and disengage from the receiving members 90 extending from the lid housing 40. When the locking arms 98 are disengaged from the receiving members 90 the entire seal assembly 60 can be rotated away from the lid housing 40 about the extensions 86 of the hinge member 56 for cleaning.

The lid assembly 14 also has a trigger locking mechanism 44 to prevent the trigger 42 from being actuated when the trigger lock mechanism 44 is in the locked position. In one embodiment the trigger lock mechanism 44 comprises a moveable vent deflector 41 with a shoulder 120 that is adapted to engage a cutout 122 in the trigger member 42 and prevent inward movement (i.e., actuation) of the trigger member 42. The vent deflector 41 can be transitioned from the unlocked position (see FIGS. 9 and 15), where the shoulder 120 of the vent deflector 41 is positioned outside of the trigger chamber 31 and thus not in contact with the trigger member 42 such that the trigger member 42 can be moved inwardly to actuate the trigger mechanism 16, to the locked position (see FIGS. 8 and 14), where the shoulder 120 of the vent deflector 41 is positioned within the trigger chamber 31 and contacting the trigger member 42 such that the trigger member 42 cannot be moved inwardly thereby preventing the trigger mechanism 16 from being actuated.

Figure 12:
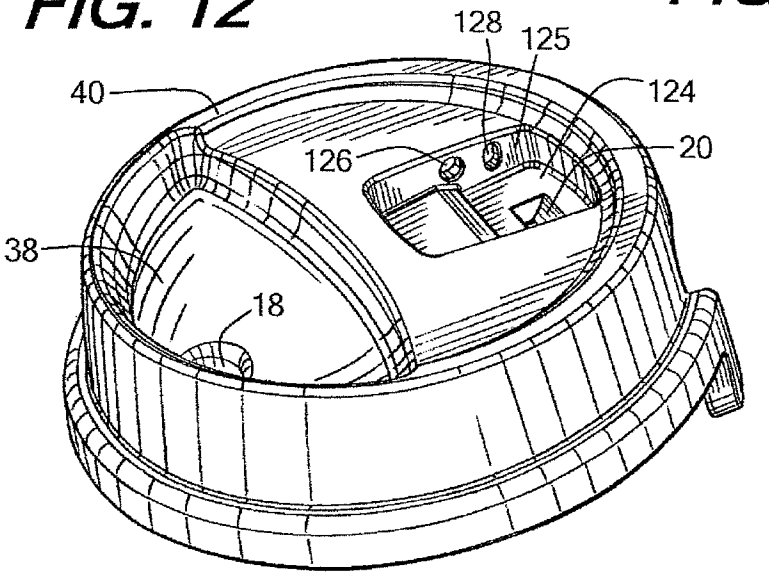
FIG. 12 is a top perspective view of one embodiment of the lid housing with the vent-trigger lock removed.
Figure 13:
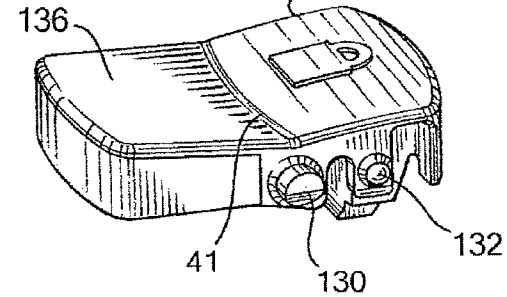
FIG. 13 is a top perspective view of one embodiment of the moveable vent-trigger lock.

Referring to FIG. 12, the lid housing 40 has a vent deflector cavity 124 for housing the vent deflector 41. The vent deflector cavity 124 has two sets of receivers in the sidewalls 125 of the vent deflector cavity 124. A first set of receivers comprises a pair of generally cylindrical openings 126, and the second set of receivers comprises a pair of slots 128. Referring to FIG. 13, the vent deflector 41 similarly has a pair of cylindrical flanges or shaft extensions 130 extending from opposing sidewalls of the vent deflector 41, and a pair of protrusions 132 similarly extending from opposing sidewalls of the vent deflector 41 distal the shaft extensions 130, although only one protrusion 132 may be required. The shaft extensions 130 reside in the cylindrical receivers 126 to allow the vent deflector 41 to pivot about the shaft extensions 130 from the locked position to the unlocked position of the trigger lock mechanism 44. Similarly, the protrusions 132 reside the in slots 128. The protrusions 132, however, operate to restrain pivoting movement of the vent deflector 41 past a certain pivot angle. Additionally, a snap fit configuration is provided at the ends of the slots 128 for maintaining the vent deflector 41 in the locked or unlocked position until moved by the user, thereby prevented unwanted movement of the vent deflector 41.

Figure 14:
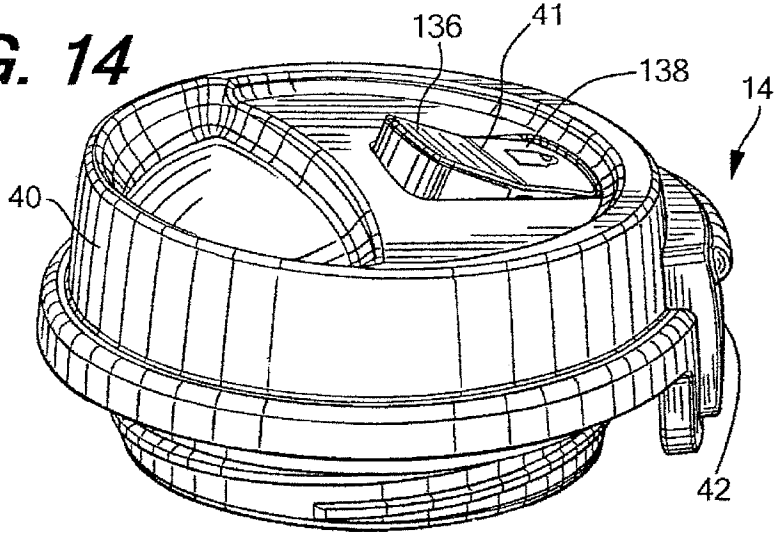
FIG. 14 is a top-side perspective view of the lid housing of FIG. 12 with the vent-trigger lock in the locked position.
Figure 15:
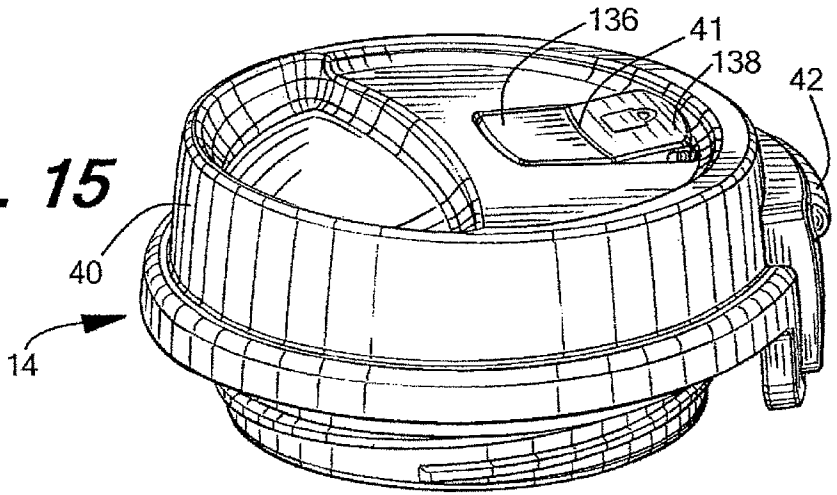
FIG. 15 is a top-side perspective view of the lid housing of FIG. 12 with the vent-trigger lock in the unlocked position.

Referring to FIGS. 8 and 14, when the front end 136 of the vent deflector 41 toward the drink aperture 18 is in the up position the rear end 138 of the vent deflector 41 is in the down position and the shoulder 120 engages the cutout 122 in the trigger member 42 to prevent inward movement (i.e., actuation) of the trigger member 42. The front end 136 of the vent deflector 41 may have a visual indicator, such as a red color or words, such as "LOCKED", that appears when the trigger lock mechanism 44 is in the locked position to indicate to the user that the trigger mechanism 16 is locked and cannot be actuated. To allow for actuation, the user presses down on the front end 136 of the vent deflector 41, thereby pivoting the front end 136 downward and the rear end 138 of the vent deflector 41 upward as shown in FIGS. 15 and 9. In this position, the shoulder 120 disengages from the cutout 122 in the trigger member 42 and allows the trigger member 42 to move inwardly when a force is applied by the user to the trigger member 42. In one embodiment the top surface 134 of the vent deflector 41 has a somewhat concave shape. To return the trigger lock mechanism 44 to the locked orientation, after the trigger 42 is positioned in its unactuated location, the user depresses the rear portion 138 of the vent deflector 41 to place the shoulder 120 of the vent deflector 41 to once again engage the cutout 122 and prevent actuation of the trigger mechanism 16.

Referring to FIGS. 16-19, an alternate embodiment of a lid assembly 214 is disclosed. In this alternate embodiment, like components to the prior embodiment have like reference numbers but in the 200/300-series, and generally operate similarly. As in the prior embodiment, this embodiment of the lid assembly 214 has a lid housing 240 that retains a trigger mechanism 216. The trigger mechanism 216 operates to open and close a drinking aperture 218 in the lid assembly 214.

Figure 19:
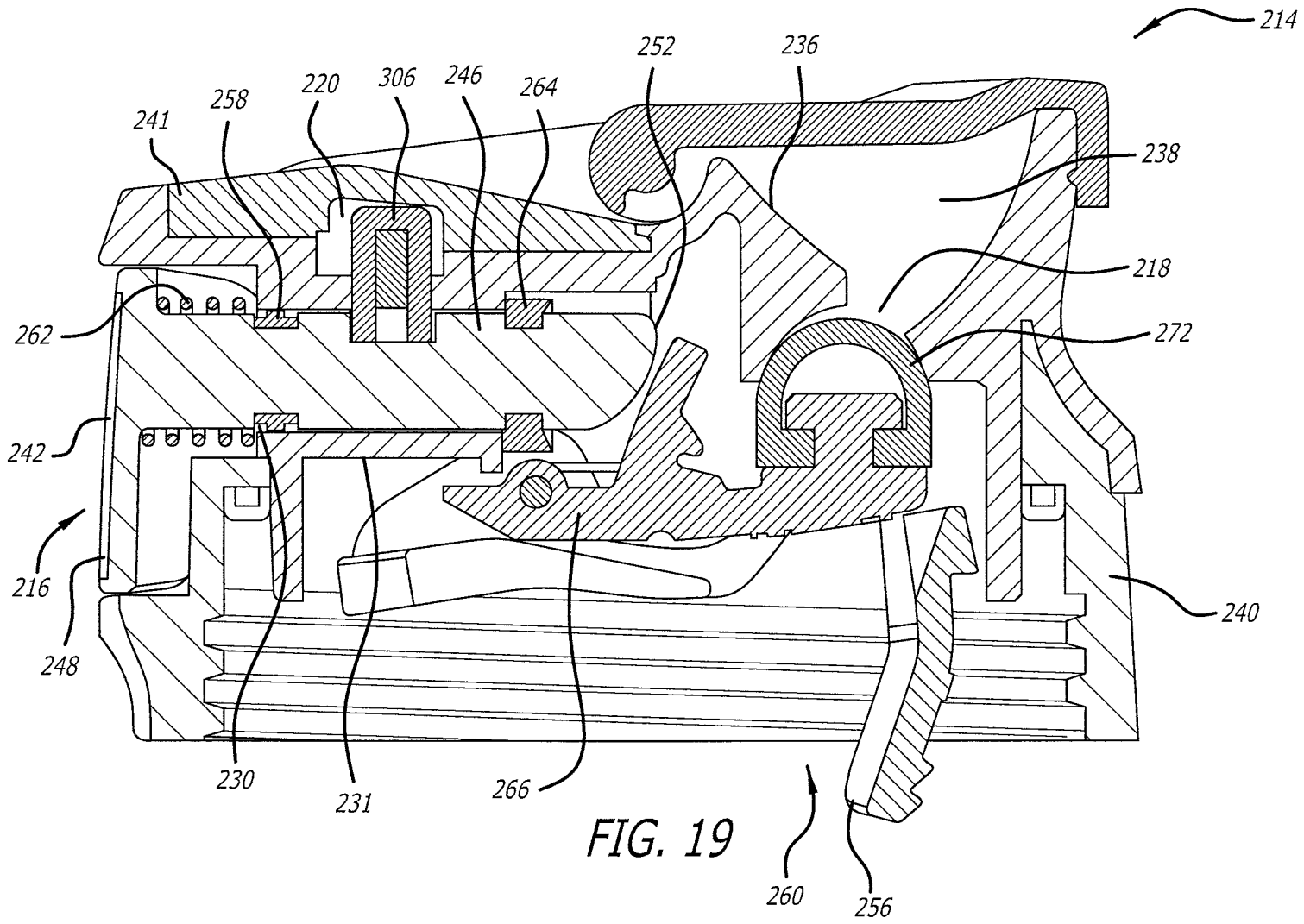
FIG. 19 is a cross-sectional side view of the lid housing of FIG. 16 with the trigger lock mechanism in the locked position.

In one embodiment, as shown in FIG. 19, the top surface 236 of the lid housing 240 has a depression 238 leading to the drink aperture 218. The depression in the top surface 236 allows fluid to be dispensed from the container through the drink aperture 218, and to be subsequently slurped by the user.

As shown in FIGS. 16-19, the lid assembly 214 also has a trigger member or trigger button 242 that operates to actuate the trigger mechanism 216, and the lid assembly 214 also has a trigger lock mechanism 244 for locking the trigger member 242 and preventing the user from actuating the trigger mechanism 216 when the trigger member 242 is locked to prevent unwanted opening of the drink aperture 218.

The lid housing 240 of the lid assembly 214 has a plurality of apertures therein. Preferably, the lid housing 240 contains the drink aperture 218 (see FIG. 19) and the vent aperture 220 (see FIG. 16) that provide egress for the contents in the container cavity through the lid housing 240. Generally, the operation of the trigger assembly 216, and particularly the operation of the vent seal 264 of the vent aperture 220, provides to allow pressure residing within the container body to preferably be initially released through the vent aperture 220 as opposed to the drink aperture 218. In one embodiment, the vent aperture 220 is provided in a position in the lid housing 240 that is underneath the vent deflector 241.

As best shown in FIG. 19, in one embodiment the trigger assembly 216 generally comprises a trigger member 242, a hinge member 256, a trigger seal 258, a trigger spring 262, a vent seal 264, a seal arm 266, a drink spring, and a drink seal 272. Further, a portion of the overall trigger assembly 216 may be referred to as the seal assembly 260. In one embodiment the components of the seal assembly 260 generally comprise the hinge member 256, the seal arm 266, the drink spring and the drink seal 272.

In one embodiment the trigger member 242 of the trigger assembly 216 has a main body portion 246 and a push-button portion 248 extending therefrom. Moreover, in a preferred embodiment the main body portion 246 has a shaft-like shape. The main body portion 246 of the trigger member 242, however, has various cutouts about an exterior of its body to allow gaseous fluid to pass by the exterior of the trigger member and out the vent aperture 220. The trigger member 242 has a distal end 252 that engages the seal arm 266 to rotate the seal arm 266 about its pivot point, as discussed more fully herein, including with respect to alternate embodiments, thereby disengaging the drink seal 272 from the drink aperture 218 in the lid assembly 214 to operably open and close the drink aperture 218.

The main body portion 246 of the trigger 242 extends through an access aperture 230 in the lid housing 240, and into a trigger chamber 231 in the lid assembly 214. A portion of the main body portion 246 of the trigger 242 is generally housed within the trigger chamber 231, and a portion of the main body portion 246 of the trigger 242, including the distal end of the trigger 252, extends out of the trigger chamber 231, which can also be referred to as the vent chamber, and into the cavity of the lid assembly 214 to contact the seal arm 266.

In a preferred embodiment the trigger 242 also seats several seals, including the trigger seal 258 and the vent seal 264. As shown in FIG. 19, the trigger seal 258 and the vent seal 264 are both seated on the main body portion 246 of the trigger 242. Since the trigger 242 extends through the access aperture 230 and through the vent chamber, the trigger seal 258 is required to seal the access aperture opening 230 once the trigger 242 is inserted into the lid assembly 214.

The vent seal 264 is also seated on the main body portion 246 of the trigger 242. Accordingly, in this manner the vent seal 264 operates to seal the entrance to the vent chamber and trigger chamber 231 in a first normal position, as shown in FIG. 19, and to open the entrance to the vent chamber and trigger chamber 231 immediately upon actuation of the trigger mechanism 216.

In one embodiment a portion of the trigger assembly 216, preferably the seal assembly 260, is hingedly connected to the lower or interior portion of the lid housing 240 of the lid assembly 214. The hinge member 256, and the seal assembly 260 therewith, can rotate down from its engaged position in the unlocked position of the seal assembly 260 to allow access to various components of the seal assembly 260, trigger assembly 216 and lid assembly 214 for cleaning purposes.

The lid assembly 214 also has a trigger locking mechanism 244 to prevent the trigger 242 from being actuated when the trigger lock mechanism 244 is in the locked position. In one embodiment, as shown in FIGS. 16-19, the trigger lock mechanism 244 comprises a trigger lock 300 moveable from a locked first position (shown in FIG. 17) to an unlocked second position (shown in FIG. 18). Additionally, the trigger lock 300 may be adjacent a side of the lid housing 240. As explained herein, when the trigger lock 300 engages the trigger member 242 in the first position the trigger lock 300 prevents the trigger member 242 from moving the seal arm 266, and when the trigger lock 300 is in the second position the trigger lock 300 does not prevent the trigger member 242 from being actuated to move the seal arm 266 to open and close the drink aperture 218.

Figure 16:
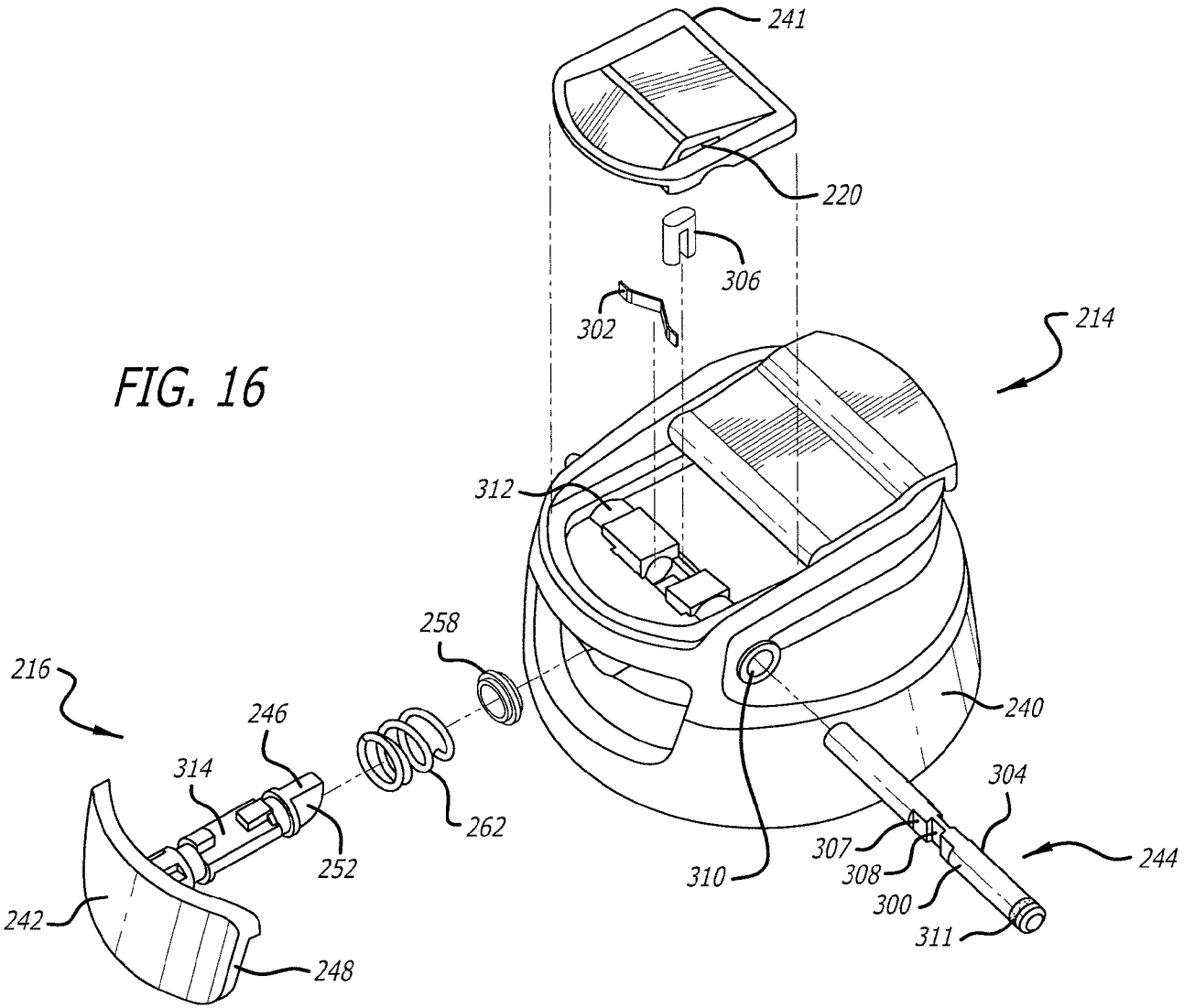
FIG. 16 is an exploded top-side perspective view of an alternate embodiment of a lid housing having a trigger lock mechanism.

As best shown in FIG. 16, in one embodiment, the trigger locking mechanism 244 comprises the trigger lock 300 and a spring 302. The spring 302 may assist in detenting the trigger lock 300 into either the locked position or the unlocked position and maintaining the trigger lock 300 in the first position and the second position, respectively, until a sufficient force is applied to the trigger lock 300 to overcome the spring resistance force of the spring 302. Further, the trigger lock 300 of the trigger locking mechanism 244 may comprise a locking shaft 304 and a stopper 306 connected to the locking shaft 304. The locking shaft 304 has a first cutout 307 about an exterior of its body to receive and to properly seat spring 302, and a second cutout 308 to seat the stopper 306. In one embodiment the stopper 306 may be a U-shaped clip that is received in the second cutout 308 and resides in the second cutout 308 as shown in FIGS. 16 and 19.

Referring to FIG. 16, in one embodiment the lid housing 240 may have a first aperture 310 at one side of the lid housing 240, and a second aperture 312 at an opposing side of the lid housing 240. The locking shaft 304 extends through the lid housing 240, from the first aperture 310 to the second aperture 312. In a preferred embodiment, the locking shaft 304 extends partially out of the second aperture 312 when the trigger lock 300 is in the first position (i.e., the locked position—see FIG. 17), and the locking shaft 304 extends partially out of the first aperture 310 when the trigger lock 300 is in the second position (i.e., the unlocked position—see FIG. 18). The trigger lock 300 may have a visual indicator 311 at one or more ends of the locking shaft 304 of the trigger lock 300 so that the user knows whether the locking mechanism is in the locked position or the unlocked position. In one embodiment, the visual indicator 311 may be a colored ring on the locking shaft 304. If the colored ring 311 is visible out of the first aperture 310, the user knows that the trigger lock is in the locked position. If the colored ring 311 is visible out of the second aperture 312 or not visible at all, the user knows that the trigger lock is in the unlocked position and that they can operate the trigger mechanism to open and close the drink seal.

Figure 17:
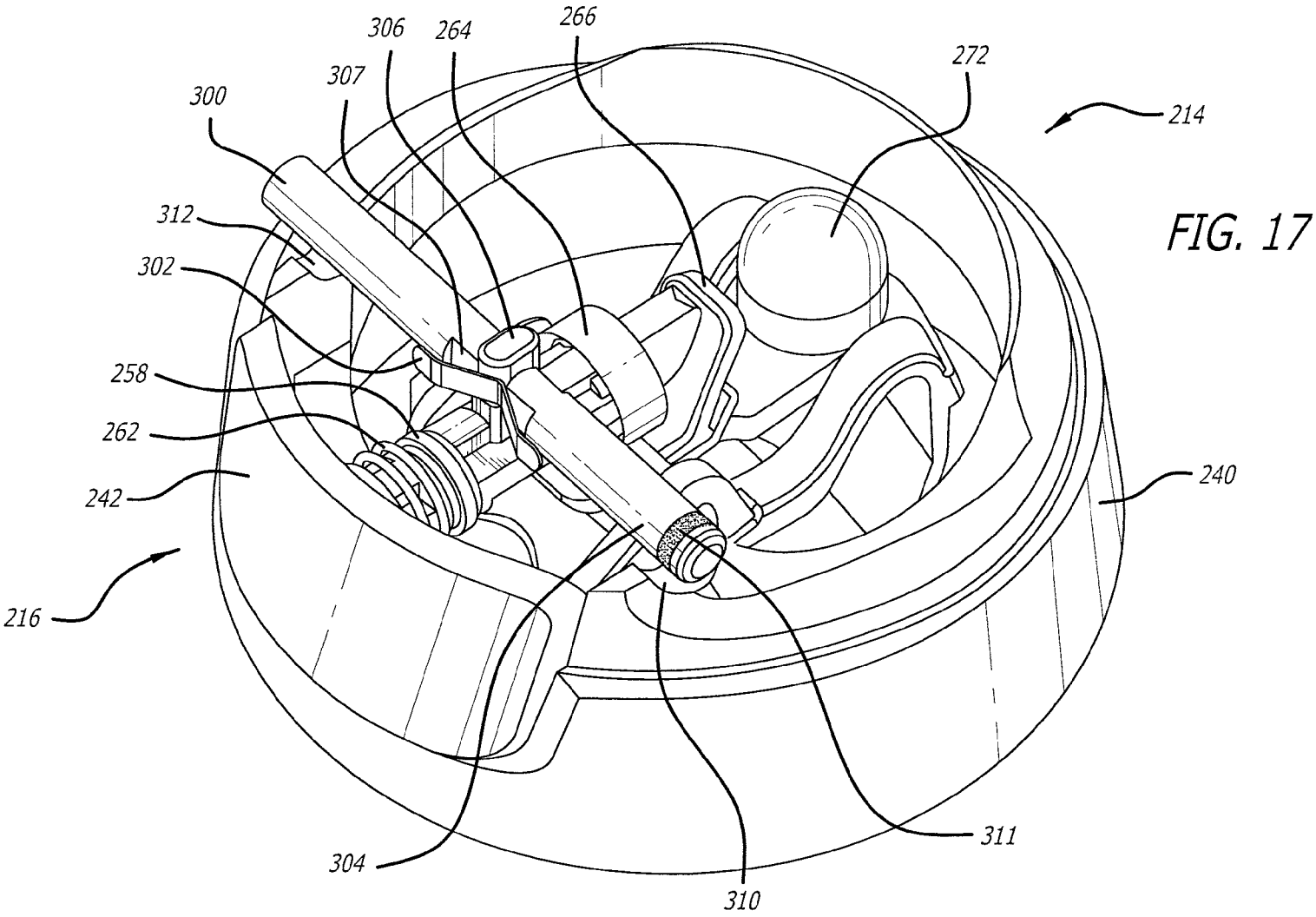
FIG. 17 is a top-side perspective view of the lid housing of FIG. 16 with the trigger lock mechanism in the locked position and with a portion of the top surface of the lid housing removed.
Figure 18:
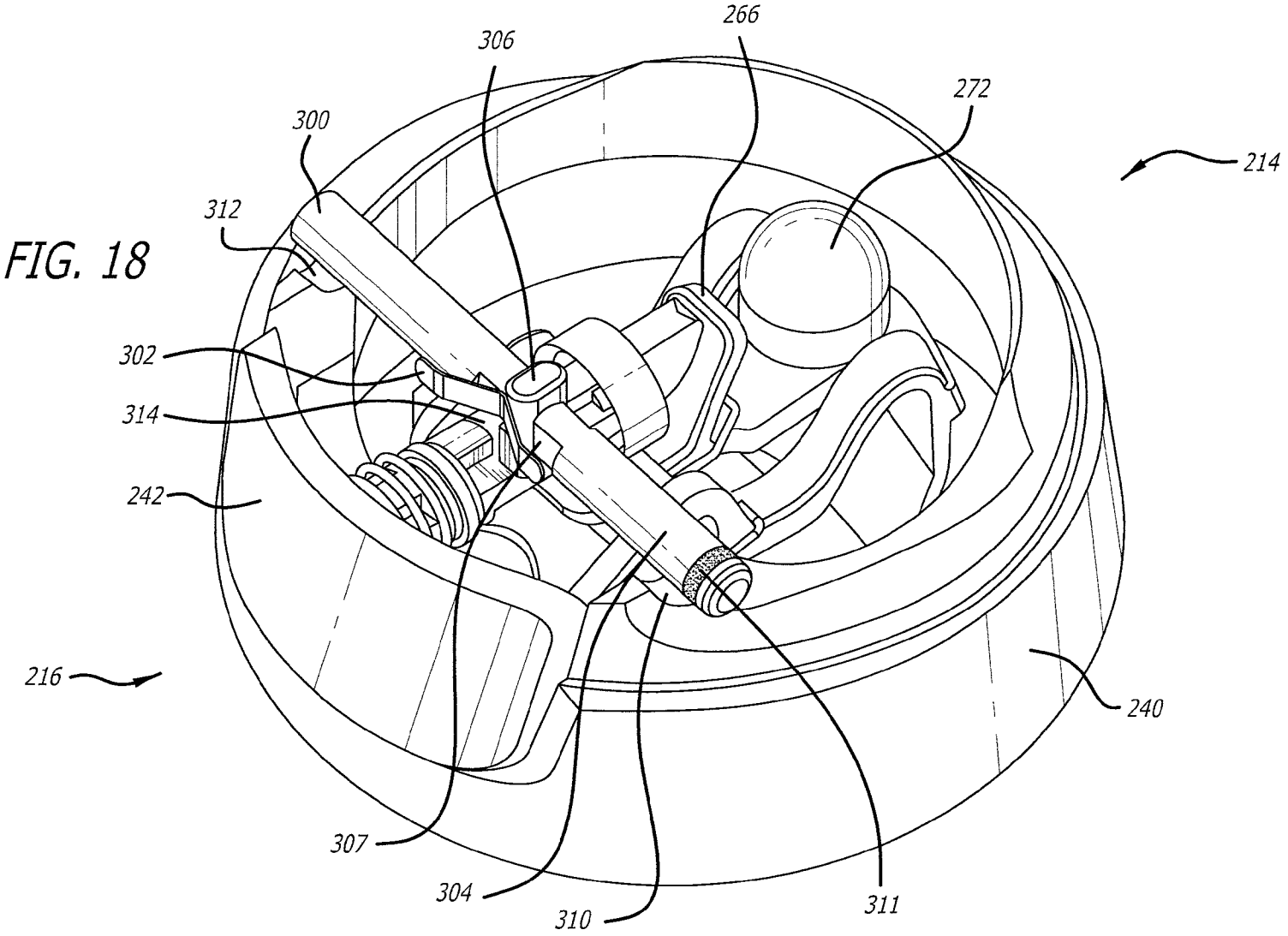
FIG. 18 is a top-side perspective view of the lid housing of FIG. 16 with the trigger lock mechanism in the unlocked position and with a portion of the top surface of the lid housing removed.

As best shown in FIGS. 16-18, and as explained above, the main body portion 246 of the trigger member 242 has various cutouts about an exterior of its body to allow gaseous fluid to pass by the exterior of the trigger member and out the vent aperture 220. Generally, these cutouts extend longitudinally about a longitudinal axis of the main body portion 246 of the trigger member 242. Additionally, the main body portion 246 has a trigger lock cutout 314 for receiving the trigger lock 300 of the trigger locking mechanism 244. The trigger lock cutout 314 generally is transverse to the longitudinal axis of the main body portion 246 of the trigger member 242, and therefore provides a cut through one of the longitudinal ribs on the main body portion 246 of the trigger member 242. The trigger lock 300 extends through the trigger lock cutout 314 as shown in FIGS. 17-19. In the first position of the trigger lock 300, the stopper 306 engages a wall of the trigger lock cutout 314 to prevent the trigger member 242 from being pushed inwardly, thereby locking the trigger member 242 and preventing actuation of the trigger mechanism. Accordingly, when the trigger lock 300 engages the trigger member 242 in the first position the trigger lock 300 prevents the trigger member 242 from operating the drink seal to open the drink opening. Conversely, when the user pushes the second end of the locking shaft 304 so that the locking shaft extends partially out of the first aperture 310, the locking mechanism will be in the second position and the stopper 306 will be outside of the trigger lock cutout 314, and therefore the stopper 310 will not prevent the trigger member 242 from being moved radially inwardly to engage the seal assembly to open and close the drink seal. To transition the locking mechanism to the locked state the user merely pushes the first end of the locking shaft 304 inwardly so that the locking shaft 304 extends partially out of the second aperture 312 and the stopper 306 engages the trigger member 242.

Figure 20:
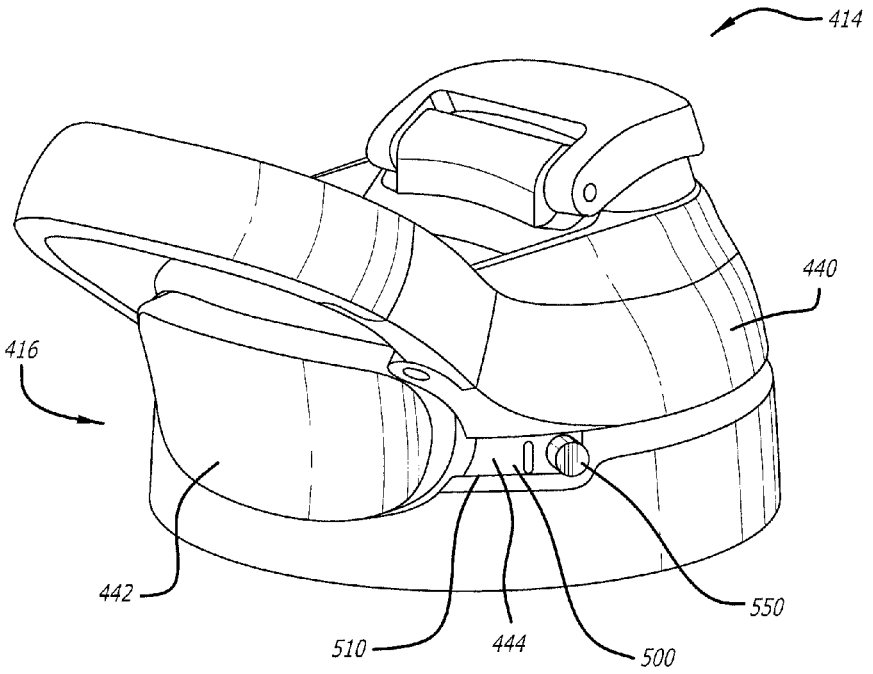
FIG. 20 is a perspective view of an alternate embodiment of a lid housing having a trigger lock mechanism.

Referring to FIGS. 20-23, a further alternate embodiment of the lid assembly 414 is disclosed. In this alternate embodiment, like components to the prior embodiments have like reference numbers, but in the 400/500-series, and generally operate similarly. As shown in FIG. 20, in this embodiment the lid assembly 414 has a lid housing 440 that retains a trigger mechanism 416. The trigger mechanism 416 operates to open and close the drinking aperture in the lid assembly 414. The lid assembly 414 also has a trigger member or trigger button 442 that operates to actuate the trigger mechanism 416. Further, the lid assembly 414 has a trigger lock mechanism 444 for locking the trigger member 442 and preventing the user from actuating the trigger mechanism 416 when the trigger member 442 is locked to prevent unwanted opening of the drink aperture.

Figure 21:
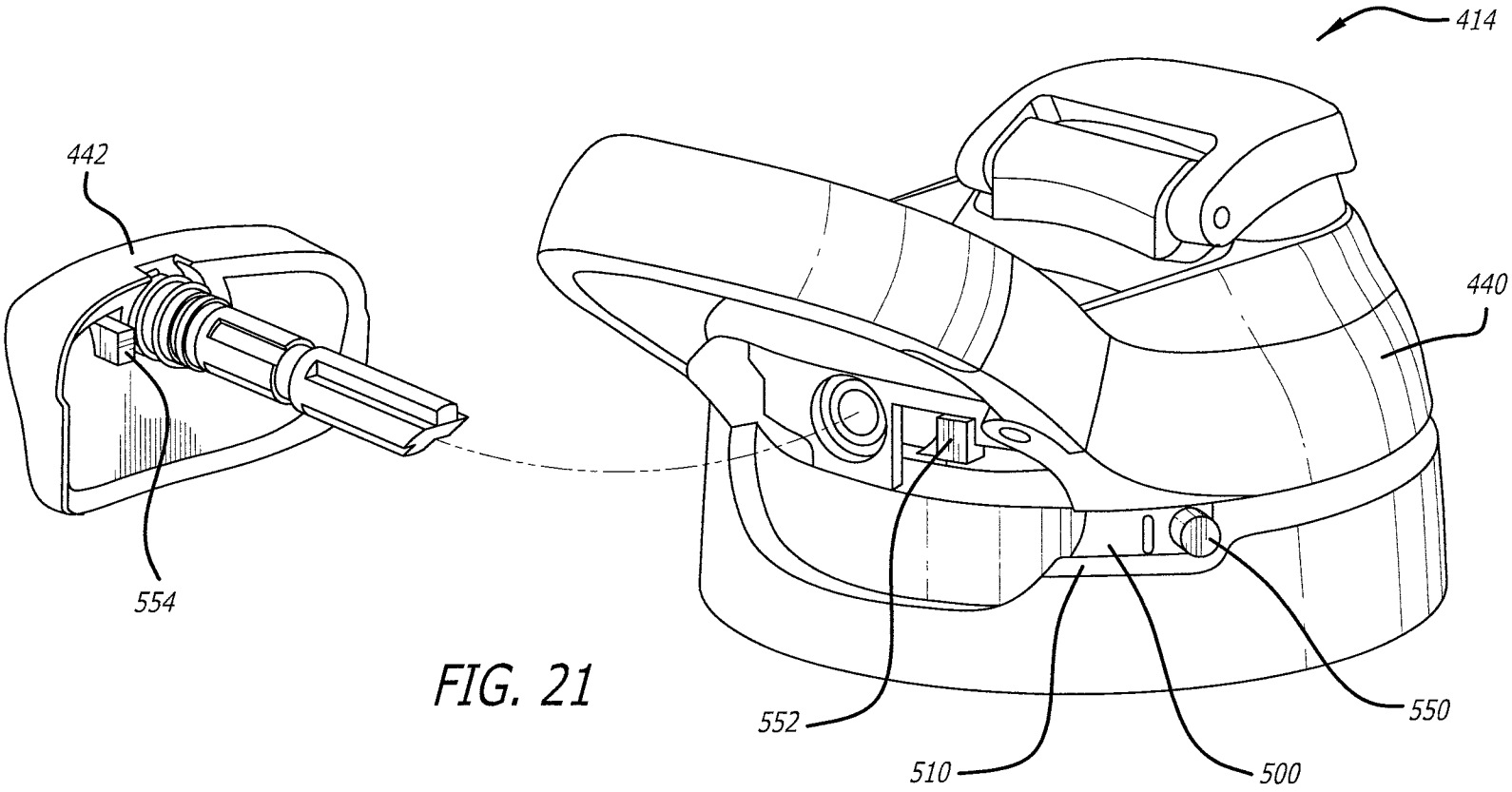
FIG. 21 is a partially exploded perspective view of the lid housing of FIG. 20.
Figure 22:
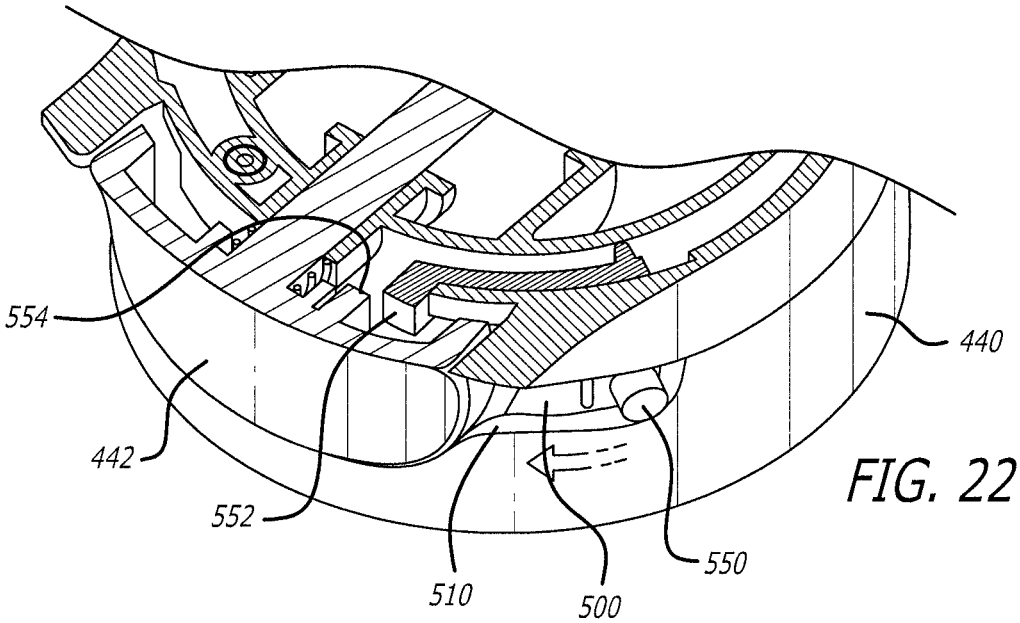
FIG. 22 is a partial cut-away perspective view of the lid housing of FIG. 20 with the trigger lock mechanism in the unlocked position.

In this embodiment, the trigger locking mechanism 444 comprises a trigger lock 500 moveable from a locked first position (shown in FIG. 23) to an unlocked second position (shown in FIGS. 21 and 22). A portion of the trigger lock 500 may be adjacent a side of the lid housing 440. As explained herein, when the trigger lock 500 engages the trigger member 442 in the first position (see FIG. 23) the trigger lock 500 prevents the trigger member 442 from moving the seal arm, and when the trigger lock 500 is in the second position (see FIG. 22) the trigger lock 500 does not prevent the trigger member 442 from being actuated to move the seal arm to open and close the drink aperture, and thus when the trigger lock 500 is in the second position the trigger mechanism 416 can be operated to open and close the drinking aperture in the lid assembly 414.

Figure 23:
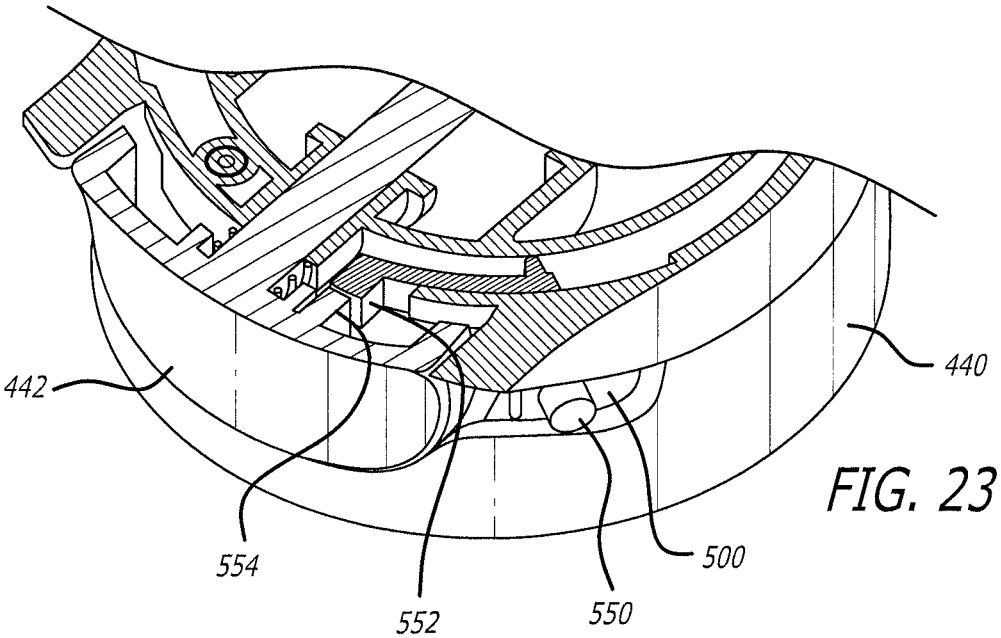
FIG. 23 is a partial cut-away perspective view of the lid housing of FIG. 20 with the trigger lock mechanism in the locked position.

As best shown in FIGS. 22 and 23, in one embodiment the trigger lock 500 comprises a slide member 500. The trigger lock 500 slides about an arcuate track in the lid housing 440 to move from the first locked position to the second unlocked position. The lid housing 440 also has an aperture 510 in the side of the lid housing 440 through which a portion of the trigger lock 500 extends, such as actuation knob 550 of the trigger lock 500 as shown in FIG. 20. The user is able to slide the trigger lock 500 in its arcuate track within the lid housing 440 from the first locked position to the second unlocked position by engaging the actuation knob 550 and pushing/pulling (as appropriate) to transition the trigger lock 500 to the desired position.

As shown in FIGS. 21-23, the trigger lock 500 also has a stopper portion 552 that engages a protrusion 554 extending from the trigger member 442 (see FIG. 21) to prevent the trigger member 442 from being actuated when the trigger lock 500 is in the first locked position (see FIG. 23). As shown in FIG. 21, in one embodiment the protrusion 554 extending from the trigger member 442 extends from a rear portion of the trigger member 442 when the trigger member 442 is inserted in position in the lid assembly 414. As shown in FIG. 22, when the trigger lock 500 is slid to the second unlocked position, the stopper portion 552 of the trigger lock 500 is positioned a distance from the protrusion 554 of the trigger member 500 and therefore the trigger member 500 can be pushed radially inwardly by the user without being stopped by the stopper portion 552 of the trigger lock 500.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lid assembly for a beverage container comprising:
a lid housing;
a seal assembly connected to the lid housing and having a seal arm and a drink seal to close a drink opening in the lid housing;
a trigger assembly connected to the lid housing to operate the seal assembly, the trigger assembly having a trigger member that engages the seal arm; and,
a trigger lock adjacent a side of the lid housing, the trigger lock moveable from a first position to a second position, wherein the trigger lock engages the trigger member in the first position to prevent the trigger member from moving the seal arm, and wherein the trigger lock does not prevent the trigger member from moving the seal arm in the second position,
wherein the trigger member has a cutout and the trigger lock has a stopper, the stopper being received in the cutout when the trigger lock is in the first position, and the stopper being positioned outside of the cutout when the trigger lock is in the second position.

2. The lid assembly of claim 1, wherein the lid housing has a first aperture at one side of the housing and a second aperture at an opposing side of the housing, and wherein the trigger lock comprises a locking shaft that partially extends out of the second aperture when the trigger lock is in the first position, and partially extends out of the first aperture when the trigger lock is in the second position.

3. The lid assembly of claim 2, wherein the stopper is connected to the locking shaft.

4. The lid assembly of claim 1, wherein the trigger lock comprises a locking shaft and the stopper is connected to the locking shaft.

5. The lid assembly of claim 1, further comprising a detent to alternately maintain the trigger lock in the first position and in the second position until a sufficient force is applied to the trigger lock to overcome a resistance of the detent.

6. The lid assembly of claim 1, further comprising a leaf spring to alternately maintain the trigger lock in the first position and in the second position until a sufficient force is applied to the trigger lock to overcome a resistance of the leaf spring.

7. The lid assembly of claim 1, wherein the trigger lock contains a visual indicator to indicate that the trigger lock is in the first position.

8. A lid assembly for a beverage container comprising:
a lid housing having a first aperture at one side of the housing and a second aperture at an opposing side of the housing;
a trigger member connected to the lid housing to operate a drink seal to close a drink opening in the lid housing; and,
a trigger lock moveable from a first locked position to a second unlocked position, wherein the trigger lock engages the trigger member in the first locked position to prevent the trigger member from operating the drink seal to open the drink opening, and wherein the trigger lock does not prevent the trigger member from moving the seal arm in the second unlocked position, a portion of the trigger lock partially extending out of the second aperture when the trigger lock is in the first locked position, and a portion of the trigger lock partially extending out of the first aperture when the trigger lock is in the second unlocked position.

9. The lid assembly of claim 8, further comprising a seal assembly connected to the lid housing, the seal assembly having a seal arm and the drink seal being connected to the seal arm.

10. The lid assembly of claim 8, wherein the trigger lock comprises a locking shaft that extends from the first aperture in the housing to the second aperture in the housing.

11. The lid assembly of claim 10, further comprising a stopper connected to the locking shaft, the stopper engaging the trigger member when the trigger lock is in the first locked position.

12. The lid assembly of claim 8, wherein the trigger member has a cutout for receiving the trigger lock.

13. The lid assembly of claim 12, wherein the trigger lock comprises a locking shaft and a stopper connected to the locking shaft, the stopper being received in the cutout when the trigger lock is in the first position.

14. The lid assembly of claim 8, further comprising a leaf spring to alternately maintain the trigger lock in the first position and in the second position until a sufficient force is applied to the trigger lock to overcome a resistance of the leaf spring.

15. The lid assembly of claim 8, wherein the trigger member moves radially inward in the lid housing and transverse to a longitudinal axis of the beverage container.

16. The lid assembly of claim 8, wherein the seal assembly is pivotally connected to the lid housing and movable between a first or operable position where the drink seal of the seal assembly engages the drink opening to close the drink opening, and a second or cleaning position where the seal assembly is rotated away from a drink surface of the lid housing and where the drink opening is open for cleaning the lid assembly.

17. A lid assembly for a drinking container comprising:

a lid housing having a drink opening;

a seal assembly pivotally connected to the lid housing and movable between a first or operable position, wherein a drink seal of the seal assembly engages a drink opening to close the drink opening, and a second or cleaning position, wherein the seal assembly is rotated away from a drink surface of the lid housing and wherein the drink opening is open for cleaning the lid assembly;

a trigger assembly connected to the lid housing to operate the seal assembly, the trigger assembly having a trigger member that engages the seal assembly; and, a trigger lock extending from the lid housing, the trigger lock moveable from a first locked position to a second unlocked position, wherein the trigger lock engages the trigger member in the first locked position to prevent the trigger member from moving the seal arm, and wherein the trigger lock does not prevent the trigger member from moving the seal arm in the second unlocked position, wherein the lid housing has a first aperture at one side of the housing and a second aperture at an opposing side of the housing, wherein the trigger lock comprises a locking shaft that extends from the first aperture in the housing to the second aperture in the housing, and wherein the trigger member has a cutout to receive a portion of the trigger lock to prevent the trigger member from operating the seal assembly when the trigger lock is moved to the first locked position.

18. A lid assembly for a beverage container comprising:

a lid housing;

a seal assembly connected to the lid housing and having a seal arm and a drink seal to close a drink opening in the lid housing;

a trigger assembly connected to the lid housing to operate the seal assembly, the trigger assembly having a trigger member that engages the seal arm;

a trigger lock adjacent a side of the lid housing, the trigger lock moveable from a first position to a second position, wherein the trigger lock engages the trigger member in the first position to prevent the trigger member from moving the seal arm, and wherein the trigger lock does not prevent the trigger member from moving the seal arm in the second position; and a leaf spring to alternately maintain the trigger lock in the first position and in the second position until a sufficient force is applied to the trigger lock to overcome a resistance of the leaf spring.

* * * * *